US009556594B2

(12) United States Patent
Shimano et al.

(10) Patent No.: US 9,556,594 B2
(45) Date of Patent: Jan. 31, 2017

(54) WORK VEHICLE

(71) Applicant: KOMATSU LTD., Tokyo (JP)

(72) Inventors: Yuki Shimano, Suita (JP); Yuto Fujii, Takatsuki (JP); Takeshi Takaura, Minoh (JP)

(73) Assignee: KOMATSU LTD., Tokyo (JP)

( * ) Notice: Subject to any disclaimer, the term of this patent is extended or adjusted under 35 U.S.C. 154(b) by 222 days.

(21) Appl. No.: 14/409,209

(22) PCT Filed: Sep. 10, 2014

(86) PCT No.: PCT/JP2014/074010
§ 371 (c)(1),
(2) Date: Dec. 18, 2014

(87) PCT Pub. No.: WO2015/025989
PCT Pub. Date: Feb. 26, 2015

(65) Prior Publication Data

US 2016/0258135 A1 Sep. 8, 2016

(51) Int. Cl.

| | |
|---|---|
| ***E02F 9/26*** | (2006.01) |
| ***E02F 9/20*** | (2006.01) |
| ***E02F 3/43*** | (2006.01) |
| *E02F 9/22* | (2006.01) |
| *E02F 3/32* | (2006.01) |

(52) U.S. Cl.
CPC ..... *E02F 9/265* (2013.01); *E02F 3/435* (2013.01); *E02F 9/2029* (2013.01); *E02F 9/262* (2013.01); *E02F 3/32* (2013.01); *E02F 9/2221* (2013.01)

(58) Field of Classification Search
CPC ..... E02F 9/2029; E02F 9/2221; E02F 9/262; E02F 9/265; G05B 19/19
See application file for complete search history.

(56) References Cited

U.S. PATENT DOCUMENTS

| | | | | |
|---|---|---|---|---|
| 5,835,874 | A | 11/1998 | Hirata et al. | |
| 2006/0112685 | A1 | 6/2006 | Devier et al. | |
| 2010/0146958 | A1 | 6/2010 | Peterson et al. | |
| 2014/0142817 | A1* | 5/2014 | Matsuyama | E02F 3/437 701/50 |
| 2014/0297040 | A1 | 10/2014 | Baba et al. | |

(Continued)

FOREIGN PATENT DOCUMENTS

| | | | |
|---|---|---|---|
| CN | 103890273 | A | 6/2014 |
| CN | 103917717 | A | 7/2014 |

(Continued)

*Primary Examiner* — Khoi Tran
*Assistant Examiner* — Dale Moyer
(74) *Attorney, Agent, or Firm* — Drinker Biddle & Reath LLP

(57) ABSTRACT

A stop control unit carries out control, when a moving speed of a bucket in a direction toward target design topography is the same in both of a first specifying state in which a bucket weight specifying portion specifies a weight of the bucket as large and a second specifying state in which the bucket weight specifying portion specifies a weight of the bucket as small, such that the moving speed of the bucket in the direction toward the target design topography is reduced from a position more distant from the target design topography in the first specifying state than in the second specifying state.

8 Claims, 15 Drawing Sheets

(56) References Cited

U.S. PATENT DOCUMENTS

2014/0336874 A1* 11/2014 Harshberger, II ..... G01G 19/10
701/36

FOREIGN PATENT DOCUMENTS

| | | | |
|---|---|---|---|
| DE | 102005049550 | A1 | 6/2006 |
| DE | 112012000540 | T5 | 11/2013 |
| JP | H09-256416 | A | 9/1997 |
| JP | H09-328774 | A | 12/1997 |
| JP | 2002-206251 | A | 7/2002 |
| JP | 5548306 | B2 | 7/2014 |
| KR | 10-0196669 | B1 | 6/1999 |

* cited by examiner (A)

(B)

WORK VEHICLE

TECHNICAL FIELD

The present invention relates to a work vehicle.

BACKGROUND ART

A work vehicle such as a hydraulic excavator includes a work implement including a boom, an arm, and a bucket. In control of the work vehicle, automatic control in which a bucket is moved based on target design topography (design topography) which is an aimed shape of an excavation target has been known.

PTD 1 has proposed a scheme for automatic control of profile work in which soil abutting to a bucket is plowed and leveled by moving the cutting edge of the bucket along a reference surface and a surface corresponding to the flat reference surface is made.

Automatic control above includes also control for automatically stopping an operation of a work implement (stop control) other than profile control above. This stop control enables automatic stop of an operation of the work implement just before target design topography such that a cutting edge of a bucket does not dig into target design topography. Such stop control is disclosed, for example, in PTD 2.

CITATION LIST

Patent Document

PTD 1: Japanese Patent Laying-Open No. 9-328774
PTD 2: Japanese Patent No. 5548306

SUMMARY OF INVENTION

Technical Problem

When a bucket different in weight is connected to an arm in replacement of a bucket, load applied to a hydraulic cylinder driving a work implement may change. When load applied to the hydraulic cylinder changes, the hydraulic cylinder may not be able to perform an expected operation in stop control. Consequently, accuracy in excavation may lower.

For example, when replacement with a bucket large in weight is made, inertia of the bucket is greater and an operation of the work implement is more difficult to stop. Therefore, accuracy in stop under stop control deteriorates.

The present invention was made to solve the problem described above, and an object of the present invention is to provide a work vehicle high in excavation accuracy.

Other tasks and novel features will become apparent from the description herein and the attached drawings.

Solution to Problem

A work vehicle according to the present invention includes a work implement, a weight specifying portion, a distance obtaining portion, and a stop control unit. The work implement includes a boom, an arm, and a bucket. The weight specifying portion serves for specifying a weight of the bucket attached to the arm. The distance obtaining portion obtains a distance between a cutting edge of the bucket and target design topography. The stop control unit carries out stop control for stopping an operation of the work implement before the cutting edge of the bucket reaches the target design topography when the cutting edge of the bucket comes closer to the target design topography. The stop control unit carries out control, when a moving speed of the bucket in a direction toward the target design topography is the same in both of a first specifying state in which the weight specifying portion specifies a weight of the bucket as a first weight and a second specifying state in which the weight specifying portion specifies a weight of the bucket as a second weight smaller than the first weight, such that the moving speed of the bucket in the direction toward the target design topography is reduced from a position more distant from the target design topography in the first specifying state than in the second specifying state.

According to the work vehicle in the present invention, even when a bucket small in weight is replaced with a bucket large in weight, the bucket being large in weight is specified. Then, a moving speed of the bucket can be reduced from a position more distant from target design topography in the first specifying state in which the weight of the bucket is large than in the second specifying state in which the weight of the bucket is small. Therefore, even when replacement with a bucket large in weight is made, invasion by a cutting edge of the bucket into the target design topography can be suppressed. Thus, an expected operation can be performed in stop control and excavation accuracy can be enhanced.

In the work vehicle above, the stop control unit has a storage portion, a selection portion, and a speed limit obtaining portion. The storage portion stores a plurality of pieces of relation data corresponding to a plurality of weights of the buckets, respectively, each piece of relation data defines defining relation between a distance between the cutting edge of the bucket and the target design topography and a speed limit of the cutting edge of the bucket. The selection portion selects one piece of relation data among the plurality of pieces of relation data stored in the storage portion, based on the weight of the bucket specified by the weight specifying portion. The speed limit obtaining portion obtains the speed limit of the cutting edge of the bucket based on the distance obtained by the distance obtaining portion, by using one piece of relation data selected by the selection portion. The stop control unit carries out stop control based on the speed limit of the cutting edge of the bucket.

By thus having the storage portion store a plurality of pieces of relation data, change in control of a bucket between a case where a bucket large in weight is employed and a case where a bucket small in weight is employed can be facilitated.

In the work vehicle above, the plurality of pieces of relation data include first relation data and second relation data. The weight of the bucket when the first relation data is selected is larger than the weight of the bucket when the second relation data is selected. The distance in the first relation data at which reduction in the speed limit of the cutting edge of the bucket is started is larger than the distance in the second relation data at which reduction in the speed limit of the cutting edge of the bucket is started.

By thus defining the first relation data and the second relation data, a moving speed of a bucket can be reduced from a position more distant from target design topography in the first specifying state in which a weight of the bucket is large, than in the second specifying state in which a weight of the bucket is small.

In the work vehicle above, the first relation data has a first deceleration section and a second deceleration section. The first deceleration section is set at a position closer to the target design topography than the second deceleration section and a degree of deceleration with change in distance between the cutting edge of the bucket and the target design topography in the second deceleration section is larger than a degree of deceleration with change in distance between the cutting edge of the bucket and the target design topography in the first deceleration section.

Thus, in moving a bucket large in weight toward target design topography, at a position distant from the target design topography, a degree of deceleration with change in distance between the cutting edge of the bucket and the target design topography can be larger so that a speed of the bucket can sharply be reduced. Alternatively, at a position close to the target design topography, a degree of deceleration with change in distance between the cutting edge of the bucket and the target design topography can be smaller so that the cutting edge of the bucket can accurately be aligned with the target design topography.

In the work vehicle above, the second relation data has a third deceleration section and a fourth deceleration section. The third deceleration section is set at a position closer to the target design topography than the fourth deceleration section and a degree of deceleration with change in distance between the cutting edge of the bucket and the target design topography in the fourth deceleration section is larger than a degree of deceleration with change in distance between the cutting edge of the bucket and the target design topography in the third deceleration section. The fourth deceleration section is set at a position closer to the target design topography than the second deceleration section.

Thus, in moving a bucket small in weight toward target design topography, at a position distant from the target design topography, a degree of deceleration with change in distance between the cutting edge of the bucket and the target design topography can be larger so that a speed of the bucket can sharply be reduced. Alternatively, at a position close to the target design topography, a degree of deceleration with change in distance between the cutting edge of the bucket and the target design topography can be smaller so that the cutting edge of the bucket can accurately be aligned with the target design topography.

The work vehicle above further includes a hydraulic cylinder which drives the work implement. The weight specifying portion specifies a weight of the bucket attached to the arm based on a pressure generated in the hydraulic cylinder while the bucket is in the air.

Thus, a weight of a bucket can automatically be specified based on a pressure generated in the hydraulic cylinder. Therefore, it is not necessary for an operator to manually input a weight of a bucket, so that efforts can be less.

The work vehicle above further includes a monitor onto which an operator can perform an operation for input of a weight of the bucket. The weight specifying portion specifies a weight of the bucket attached to the arm based on the weight of the bucket input to the monitor by the operator.

Thus, a weight of a bucket can be specified by a manual input operation performed by an operator.

The work vehicle above further includes an estimated speed determination portion and a direction control valve. The estimated speed determination portion estimates a speed of the boom based on an amount of operation of an operation member. The direction control valve has a movable spool and controls supply of a hydraulic oil to a hydraulic cylinder driving the work implement as the spool moves. The storage portion stores a plurality of pieces of correlation data corresponding to a plurality of weights of the buckets, respectively, each piece of correlation data showing relation between a cylinder speed of the hydraulic cylinder and an operation command value for operating the hydraulic cylinder. The estimated speed determination portion selects one piece of correlation data from among the plurality of pieces of correlation data stored in the storage portion based on the weight of the bucket specified by the weight specifying portion and obtains an estimated speed of the boom by using selected one piece of correlation data. The stop control unit carries out stop control based on the estimated speed of the boom and the speed limit of the boom.

Thus, alignment of the cutting edge of the bucket with target design topography in stop control is further facilitated and excavation accuracy can further be enhanced.

Advantageous Effects of Invention

As described above, according to the present invention, a work vehicle high in excavation accuracy can be realized.

DESCRIPTION OF EMBODIMENTS

An embodiment of the present invention will be described hereinafter with reference to the drawings. The present invention is not limited thereto. Constituent features in each embodiment described below can be combined as appropriate. Some components may not be employed.

<Overall Structure of Work Vehicle>

Figure 1:
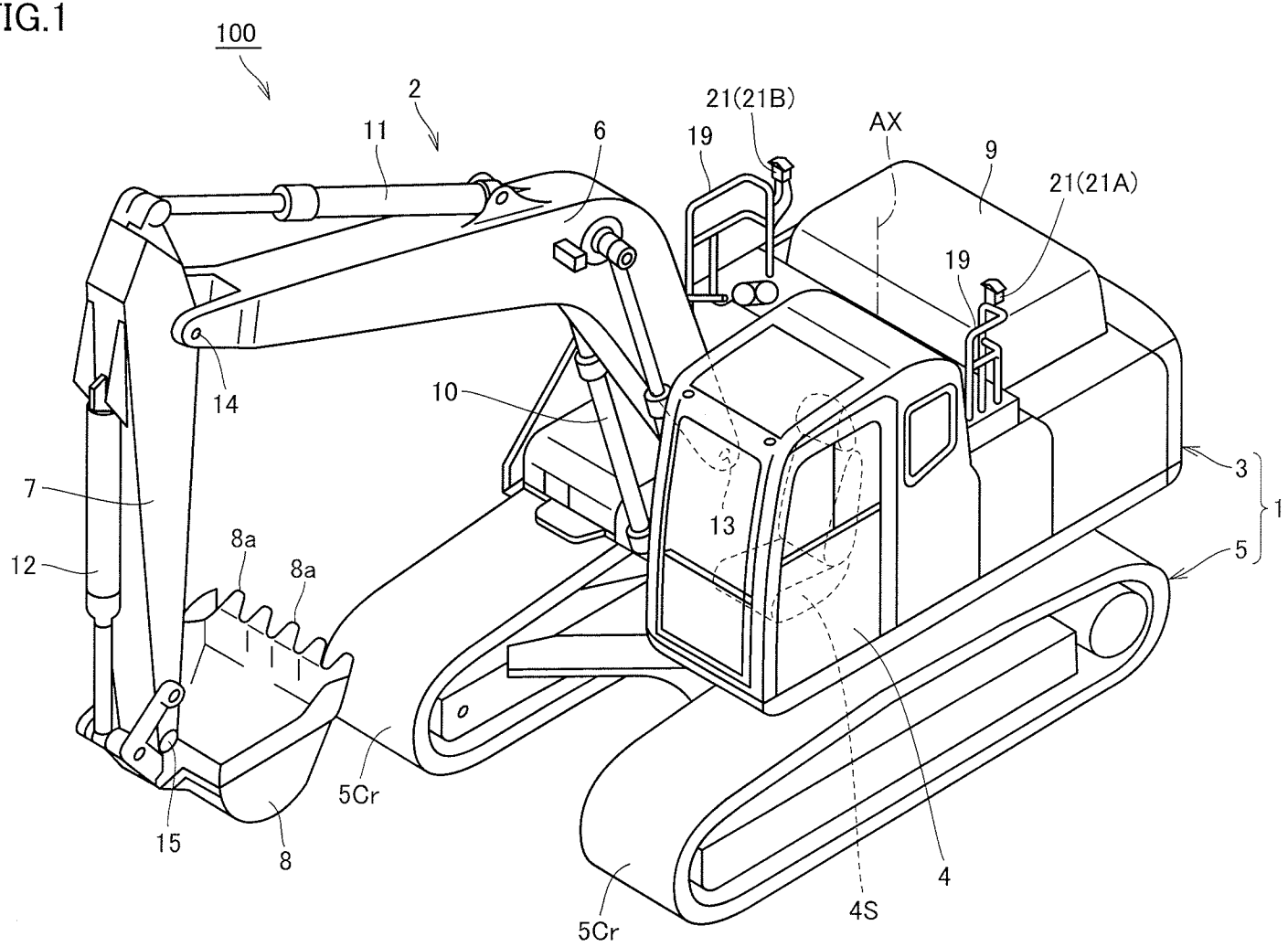
FIG. 1 is a perspective view showing a structure of a work vehicle 100 based on an embodiment.

FIG. 1 is a diagram illustrating appearance of a work vehicle 100 based on an embodiment.

As shown in FIG. 1, in the present example, a hydraulic excavator will mainly be described by way of example as work vehicle 100.

Work vehicle 100 has a vehicular main body 1 and a work implement 2 operated with a hydraulic pressure. As will be described later, a control system 200 (FIG. 3) carrying out excavation control is mounted on work vehicle 100.

Vehicular main body 1 has a revolving unit 3 and a traveling apparatus 5. Traveling apparatus 5 has a pair of crawler belts 5Cr. Work vehicle 100 can travel as crawler belts 5Cr rotate. Traveling apparatus 5 may include wheels (tires).

Revolving unit 3 is arranged on traveling apparatus 5 and supported by traveling apparatus 5. Revolving unit 3 can revolve with respect to traveling apparatus 5, around an axis of revolution AX.

Revolving unit 3 has an operator's cab 4. This operator's cab 4 is provided with an operator's seat 4S where an operator sits. The operator can operate work vehicle 100 in operator's cab 4.

In the present example, positional relation among portions will be described with the operator seated at operator's seat 4S being defined as the reference. A fore/aft direction refers to a fore/aft direction of the operator who sits at operator's seat 4S. A lateral direction refers to a lateral direction of the operator who sits at operator's seat 4S. A direction in which the operator sitting at operator's seat 4S faces is defined as a fore direction and a direction opposed to the fore direction is defined as an aft direction. A right side and a left side at the time when the operator sitting at operator's seat 4S faces front are defined as a right direction and a left direction, respectively.

Revolving unit 3 has an engine compartment 9 accommodating an engine and a counter weight provided in a rear portion of revolving unit 3. In revolving unit 3, a handrail 19 is provided in front of engine compartment 9. In engine compartment 9, an engine and a hydraulic pump which are not shown are arranged.

Work implement 2 is supported by revolving unit 3. Work implement 2 has a boom 6, an arm 7, a bucket 8, a boom cylinder 10, an arm cylinder 11, and a bucket cylinder 12. Boom 6 is connected to revolving unit 3. Arm 7 is connected to boom 6. Bucket 8 is connected to arm 7.

Boom cylinder 10 serves to drive boom 6. Arm cylinder 11 serves to drive arm 7. Bucket cylinder 12 serves to drive bucket 8. Each of boom cylinder 10, arm cylinder 11, and bucket cylinder 12 is implemented by a hydraulic cylinder driven with a hydraulic oil.

A base end portion of boom 6 is connected to revolving unit 3 with a boom pin 13 being interposed. A base end portion of arm 7 is connected to a tip end portion of boom 6 with an arm pin 14 being interposed. Bucket 8 is connected to a tip end portion of arm 7 with a bucket pin 15 being interposed.

Boom 6 can pivot around boom pin 13. Arm 7 can pivot around arm pin 14. Bucket 8 can pivot around bucket pin 15.

Each of arm 7 and bucket 8 is a movable member movable on a tip end side of boom 6. Bucket 8 is provided as being replaceable with respect to arm 7. For example, depending on details of excavation work, an appropriate type of bucket 8 is selected and selected bucket 8 is connected to arm 7.

Figure 2:
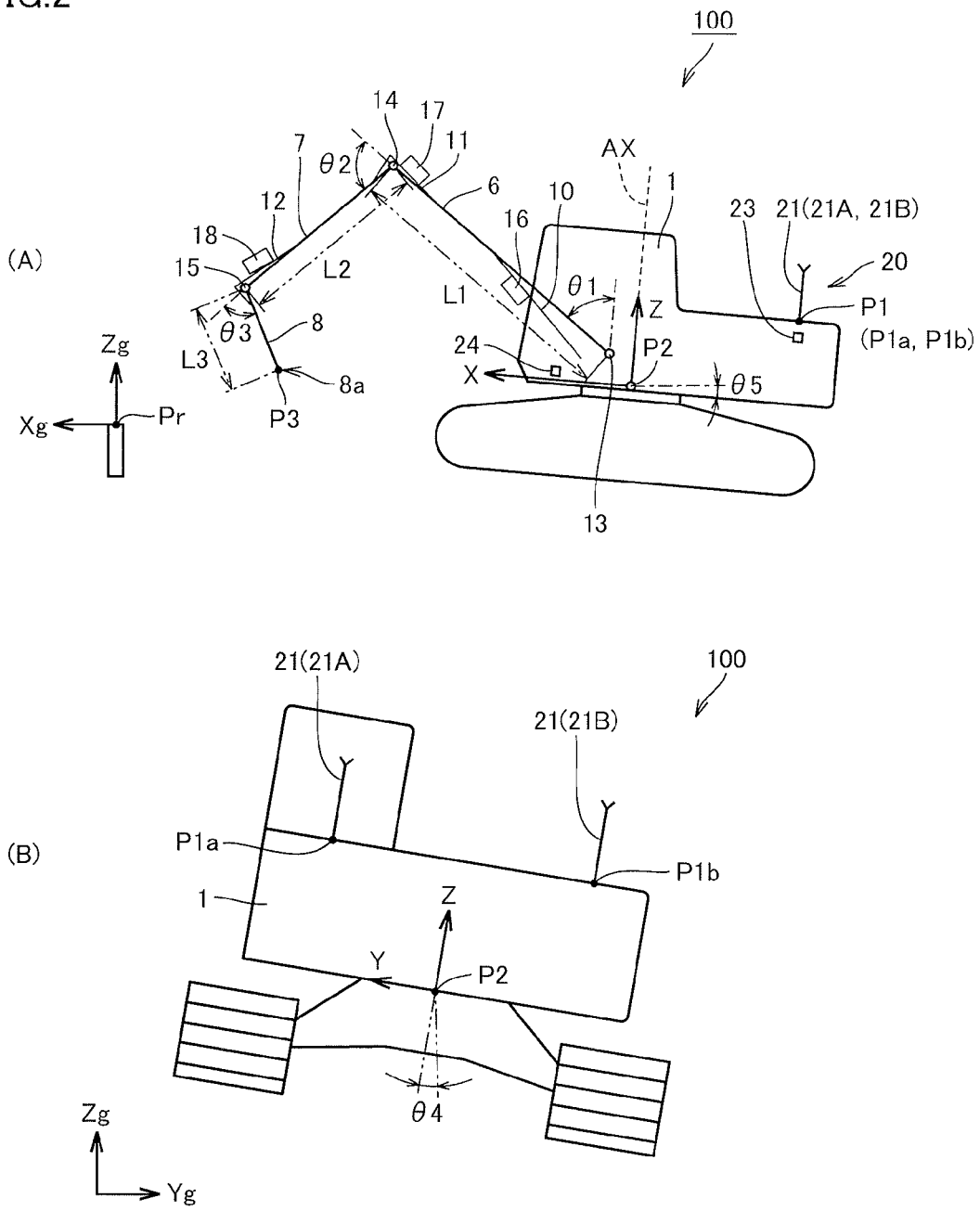
FIG. 2 is (A) a side view and (B) a rear view schematically showing the structure of work vehicle 100 based on the embodiment.

FIGS. 2 (A) and 2 (B) are diagrams schematically illustrating work vehicle 100 based on the embodiment. FIG. 2 (A) shows a side view of work vehicle 100. FIG. 2 (B) shows a rear view of work vehicle 100.

As shown in FIGS. 2 (A) and 2 (B), a length L1 of boom 6 refers to a distance between boom pin 13 and arm pin 14. A length L2 of arm 7 refers to a distance between arm pin 14 and bucket pin 15. A length L3 of bucket 8 refers to a distance between bucket pin 15 and a cutting edge 8*a* of bucket 8. Bucket 8 has a plurality of blades and a tip end portion of bucket 8 is called cutting edge 8*a* in the present example.

Bucket 8 does not have to have a blade. The tip end portion of bucket 8 may be formed from a steel plate having a straight shape.

Work vehicle 100 has a boom cylinder stroke sensor 16, an arm cylinder stroke sensor 17, and a bucket cylinder stroke sensor 18. Boom cylinder stroke sensor 16 is arranged in boom cylinder 10. Arm cylinder stroke sensor 17 is arranged in arm cylinder 11. Bucket cylinder stroke sensor 18 is arranged in bucket cylinder 12. Boom cylinder stroke sensor 16, arm cylinder stroke sensor 17, and bucket cylinder stroke sensor 18 are also collectively referred to as a cylinder stroke sensor.

A stroke length of boom cylinder 10 is found based on a result of detection by boom cylinder stroke sensor 16. A stroke length of arm cylinder 11 is found based on a result of detection by arm cylinder stroke sensor 17. A stroke length of bucket cylinder 12 is found based on a result of detection by bucket cylinder stroke sensor 18.

In the present example, stroke lengths of boom cylinder 10, arm cylinder 11, and bucket cylinder 12 are also referred to as a boom cylinder length, an arm cylinder length, and a bucket cylinder length, respectively. In the present example, a boom cylinder length, an arm cylinder length, and a bucket cylinder length are also collectively referred to as cylinder length data L. A scheme for detecting a stroke length with the use of an angle sensor can also be adopted.

Work vehicle 100 includes a position detection apparatus 20 which can detect a position of work vehicle 100.

Position detection apparatus 20 has an antenna 21, a global coordinate operation portion 23, and an inertial measurement unit (IMU) 24.

Antenna 21 is, for example, an antenna for global navigation satellite systems (GNSS). Antenna 21 is, for example, an antenna for real time kinematic-global navigation satellite systems (RTK-GNSS).

Antenna 21 is provided in revolving unit 3. In the present example, antenna 21 is provided in handrail 19 of revolving unit 3. Antenna 21 may be provided in the rear of engine compartment 9. For example, antenna 21 may be provided in the counter weight of revolving unit 3. Antenna 21 outputs a signal in accordance with a received radio wave (a GNSS radio wave) to global coordinate operation portion 23.

Global coordinate operation portion 23 detects an installation position P1 of antenna 21 in a global coordinate system. The global coordinate system is a three-dimensional coordinate system (Xg, Yg, Zg) based on a reference position Pr installed in an area of working. In the present example, reference position Pr is a position of a tip end of a reference marker set in the area of working. A local coordinate system is a three-dimensional coordinate system expressed by (X, Y, Z) with work vehicle 100 being defined as the reference. A reference position in the local coordinate system is data representing a reference position P2 located at axis of revolution (center of revolution) AX of revolving unit 3.

In the present example, antenna 21 has a first antenna 21A and a second antenna 21B provided in revolving unit 3 as being distant from each other in a direction of a width of the vehicle.

Global coordinate operation portion 23 detects an installation position P1*a* of first antenna 21A and an installation position P1*b* of second antenna 21B. Global coordinate operation portion 23 obtains reference position data P expressed by a global coordinate. In the present example, reference position data P is data representing reference position P2 located at axis of revolution (center of revolution) AX of revolving unit 3. Reference position data P may be data representing installation position P1.

In the present example, global coordinate operation portion 23 generates revolving unit orientation data Q based on two installation positions P1*a* and P1*b*. Revolving unit orientation data Q is determined based on an angle formed by a straight line determined by installation position P1*a* and installation position P1*b* with respect to a reference azimuth (for example, north) of the global coordinate. Revolving unit orientation data Q represents an orientation in which revolving unit 3 (work: implement 2) is oriented. Global coordinate operation portion 23 outputs reference position data P and revolving unit orientation data Q to a display controller 28 which will be described later.

IMU 24 is provided in revolving unit 3. In the present example, IMU 24 is arranged in a lower portion of operator's cab 4. In revolving unit 3, a highly rigid frame is arranged in the lower portion of operator's cab 4. IMU 24 is arranged on that frame. IMU 24 may be arranged lateral to (on the right or left of) axis of revolution AX (reference position P2) of revolving unit 3. IMU 24 detects an angle of inclination θ4 representing inclination in the lateral direction of vehicular main body 1 and an angle of inclination θ5 representing inclination in the fore/aft direction of vehicular main body 1.

<Configuration of Control System>

Overview of control system 200 based on the embodiment will now be described.

Figure 3:
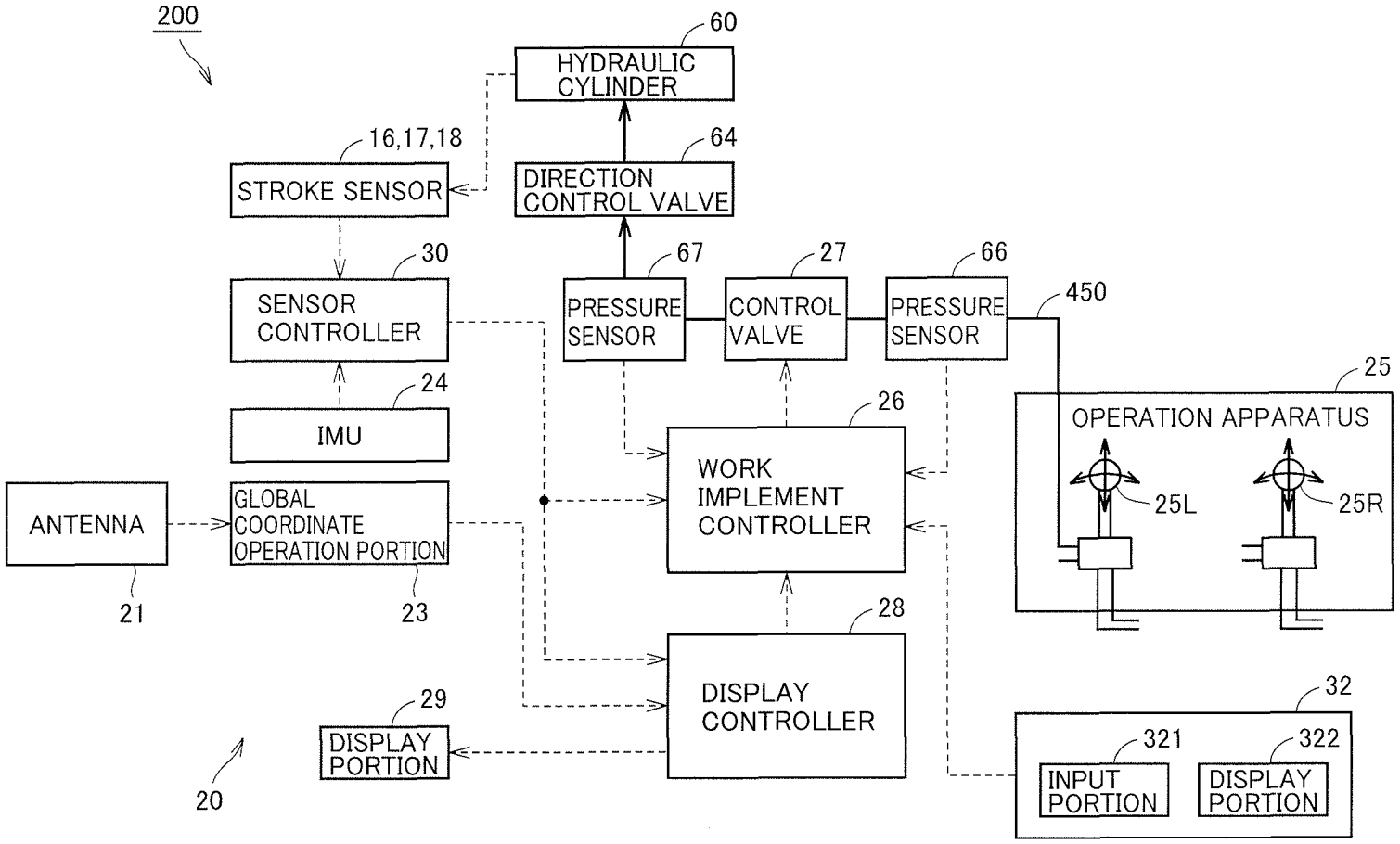
FIG. 3 is a functional block diagram illustrating a configuration of a control system 200 based on the embodiment.

FIG. 3 is a functional block diagram showing a configuration of control system 200 based on the embodiment.

As shown in FIG. 3, control system 200 controls processing for excavation with work implement 2. In the present example, control for excavation processing includes stop control and profile control.

Stop control means control for automatically stopping the work implement just before target design topography such that cutting edge 8*a* of bucket 8 does not dig into the target design topography as shown in FIG. 1. Stop control is carried out when an operator does not operate arm 7 but operates boom 6 or bucket 8 and when a distance between cutting edge 8*a* of bucket 8 and the target design topography and a speed of cutting edge 8*a* of bucket 8 satisfy a prescribed condition.

Profile control means automatic control of profile work in which soil abutting to the bucket is plowed and leveled by moving cutting edge 8*a* of bucket 8 along target design topography and a surface corresponding to flat target design topography is made, and it is also referred to as excavation limit control. Profile control is carried out when arm 7 is operated by an operator and a distance between the cutting edge of bucket 8 and target design topography and a speed of the cutting edge are within the reference. During profile control, normally, the operator operates arm 7 while he/she always operates boom 6 in a direction in which the boom is lowered.

As shown in FIG. 3, control system 200 has boom cylinder stroke sensor 16, arm cylinder stroke sensor 17, bucket cylinder stroke sensor 18, antenna 21, global coordinate operation portion 23, IMU 24, an operation apparatus 25, a work implement controller 26, a pressure sensor 66 and a pressure sensor 67, a control valve 27, a direction control valve 64, display controller 28, a display portion 29, a sensor controller 30, a man-machine interface portion 32, and a hydraulic cylinder 60.

Operation apparatus 25 is arranged in operator's cab 4 (FIG. 1). The operator operates operation apparatus 25. Operation apparatus 25 accepts an operation by the operator for driving work implement 2. In the present example, operation apparatus 25 is an operation apparatus of a pilot hydraulic type.

Direction control valve 64 regulates an amount of supply of a hydraulic oil to hydraulic cylinder 60. Direction control valve 64 operates with an oil supplied to a first hydraulic chamber and a second hydraulic chamber. In the present example, an oil supplied to hydraulic cylinder 60 (boom cylinder 10, arm cylinder 11, and bucket cylinder 12) in order to operate the hydraulic cylinder is also referred to as a hydraulic oil. An oil supplied to direction control valve 64 for operating direction control valve 64 is also referred to as a pilot oil. A pressure of the pilot oil is also referred to as a pilot oil pressure.

The hydraulic oil and the pilot oil may be delivered from the same hydraulic pump. For example, a pressure of some of the hydraulic oil delivered from the hydraulic pump may be reduced by a pressure reduction valve and the hydraulic oil of which pressure has been reduced may be used as the pilot oil. A hydraulic pump delivering a hydraulic oil (a main hydraulic pump) and a hydraulic pump delivering a pilot oil (a pilot hydraulic pump) may be different from each other.

Operation apparatus 25 has a first control lever 25R and a second control lever 25L. First control lever 25R is arranged, for example, on the right side of operator's seat 4S (FIG. 1). Second control lever 25L is arranged, for example, on the left side of operator's seat 4S. Operations of first control lever 25R and second control lever 25L in fore, aft, left, and right directions correspond to operations along two axes.

Boom 6 and bucket 8 are operated with the use of first control lever 25R.

An operation of first control lever 25R in the fore/aft direction corresponds to the operation of boom 6, and an operation for lowering boom 6 and an operation for raising boom 6 are performed in response to the operation in the fore/aft direction. A detected pressure generated in pressure sensor 66 at the time when first control lever 25R is operated in order to operate boom 6 and a pilot oil is supplied to a pilot oil path 450 is denoted as MB.

An operation of first control lever 25R in the lateral direction corresponds to the operation of bucket 8, and an excavation operation and a dumping operation by bucket 8 are performed in response to an operation in the lateral direction. A detected pressure generated in pressure sensor 66 at the time when first control lever 25R is operated in order to operate bucket 8 and a pilot oil is supplied to pilot oil path 450 is denoted as MT.

Arm 7 and revolving unit 3 are operated with the use of second control lever 25L.

An operation of second control lever 25L in the fore/aft direction corresponds to the operation of arm 7, and an operation for raising arm 7 and an operation for lowering arm 7 are performed in response to the operation in the fore/aft direction. A detected pressure generated in pressure sensor 66 at the time when second control lever 25L is operated in order to operate arm 7 and a pilot oil is supplied to pilot oil path 450 is denoted as MA.

The operation of second control lever 25L in the lateral direction corresponds to revolution of revolving unit 3, and an operation for revolving revolving unit 3 to the right and an operation for revolving revolving unit 3 to the left are performed in response to the operation in the lateral direction.

In the present example, an operation for raising boom 6 corresponds to a dumping operation. An operation for lowering boom 6 corresponds to an excavation operation. An operation for lowering arm 7 corresponds to an excavation operation. An operation for raising arm 7 corresponds to a dumping operation. An operation for lowering bucket 8 corresponds to an excavation operation. The operation for lowering arm 7 is also referred to as a bending operation. The operation for raising arm 7 is referred to as an extension operation.

A pilot oil delivered from the main hydraulic pump, of which pressure has been reduced by the pressure reduction valve, is supplied to operation apparatus 25. The pilot oil pressure is regulated based on an amount of operation of operation apparatus 25.

Pressure sensor 66 and pressure sensor 67 are arranged in pilot oil path 450. Pressure sensor 66 and pressure sensor 67 detect a pilot oil pressure (a PPC pressure). A result of detection by pressure sensor 66 and pressure sensor 67 is output to work implement controller 26.

Direction control valve 64 regulates a direction of flow and a flow rate of the hydraulic oil supplied to boom cylinder 10 for driving boom 6, in accordance with an amount of operation of first control lever 25R (an amount of operation of the boom) in the fore/aft direction.

Direction control valve 64 in which the hydraulic oil supplied to bucket cylinder 12 for driving bucket 8 flows is driven in accordance with an amount of operation of first control lever 25R (an amount of operation of the bucket) in the lateral direction.

Direction control valve 64 in which the hydraulic oil supplied to arm cylinder 11 for driving arm 7 flows is driven in accordance with an amount of operation of second control lever 25L (an amount of operation of the arm) in the fore/aft direction.

Direction control valve 64 in which the hydraulic oil supplied to a hydraulic actuator for driving revolving unit 3 flows is driven in accordance with an amount of operation of second control lever 25L in the lateral direction.

The operation of first control lever 25R in the lateral direction may correspond to the operation of boom 6 and the operation thereof in the fore/aft direction may correspond to the operation of bucket 8. The lateral direction of second control lever 25L may correspond to the operation of arm 7 and the operation in the fore/aft direction may correspond to the operation of revolving unit 3.

Control valve 27 regulates an amount of supply of the hydraulic oil to hydraulic cylinder 60 (boom cylinder 10, arm cylinder 11, and bucket cylinder 12). Control valve 27 operates based on a control signal from work implement controller 26.

Man-machine interface portion 32 has an input portion 321 and a display portion (a monitor) 322.

In the present example, input portion 321 has an operation button arranged around display portion 322. Input portion 321 may include a touch panel. Man-machine interface portion 32 is also referred to as a multi-monitor.

Display portion 322 displays an amount of remaining fuel and a coolant temperature as basic information. This display portion 322 may be implemented by a touch panel (an input apparatus) with which a device can be operated by pressing an indication on a screen.

Input portion 321 is operated by an operator. A command signal generated in response to an operation of input portion 321 is output to work implement controller 26.

Sensor controller 30 calculates a boom cylinder length based on a result of detection by boom cylinder stroke sensor 16. Boom cylinder stroke sensor 16 outputs pulses associated with a go-around operation to sensor controller 30. Sensor controller 30 calculates a boom cylinder length based on pulses output from boom cylinder stroke sensor 16.

Similarly, sensor controller 30 calculates an arm cylinder length based on a result of detection by arm cylinder stroke sensor 17. Sensor controller 30 calculates a bucket cylinder length based on a result of detection by bucket cylinder stroke sensor 18.

Sensor controller 30 calculates an angle of inclination θ1 of boom 6 with respect to a perpendicular direction of revolving unit 3 from the boom cylinder length obtained based on the result of detection by boom cylinder stroke sensor 16.

Sensor controller 30 calculates an angle of inclination θ2 of arm 7 with respect to boom 6 from the arm cylinder length obtained based on the result of detection by arm cylinder stroke sensor 17.

Sensor controller 30 calculates an angle of inclination θ3 of cutting edge 8*a* of bucket 8 with respect to arm 7 from the bucket cylinder length obtained based on the result of detection by bucket cylinder stroke sensor 18.

Positions of boom 6, arm 7, and bucket 8 of work vehicle 100 can be specified based on angles of inclination θ1, θ2, and θ3 which are results of calculation above, reference position data P, revolving unit orientation data Q, and cylinder length data L, and bucket position data representing a three-dimensional position of bucket 8 can be generated.

Angle of inclination θ1 of boom 6, angle of inclination θ2 of arm 7, and angle of inclination θ3 of bucket 8 do not have to be detected by cylinder stroke sensors 16, 17, and 18. An angle detector such as a rotary encoder may detect angle of inclination θ1 of boom 6. The angle detector detects angle of inclination θ1 by detecting an angle of bending of boom 6 with respect to revolving unit 3. Similarly, an angle detector attached to arm 7 may detect angle of inclination θ2 of arm 7. An angle detector attached to bucket 8 may detect angle of inclination θ3 of bucket 8.

<Configuration of Hydraulic Circuit>

Figure 4:
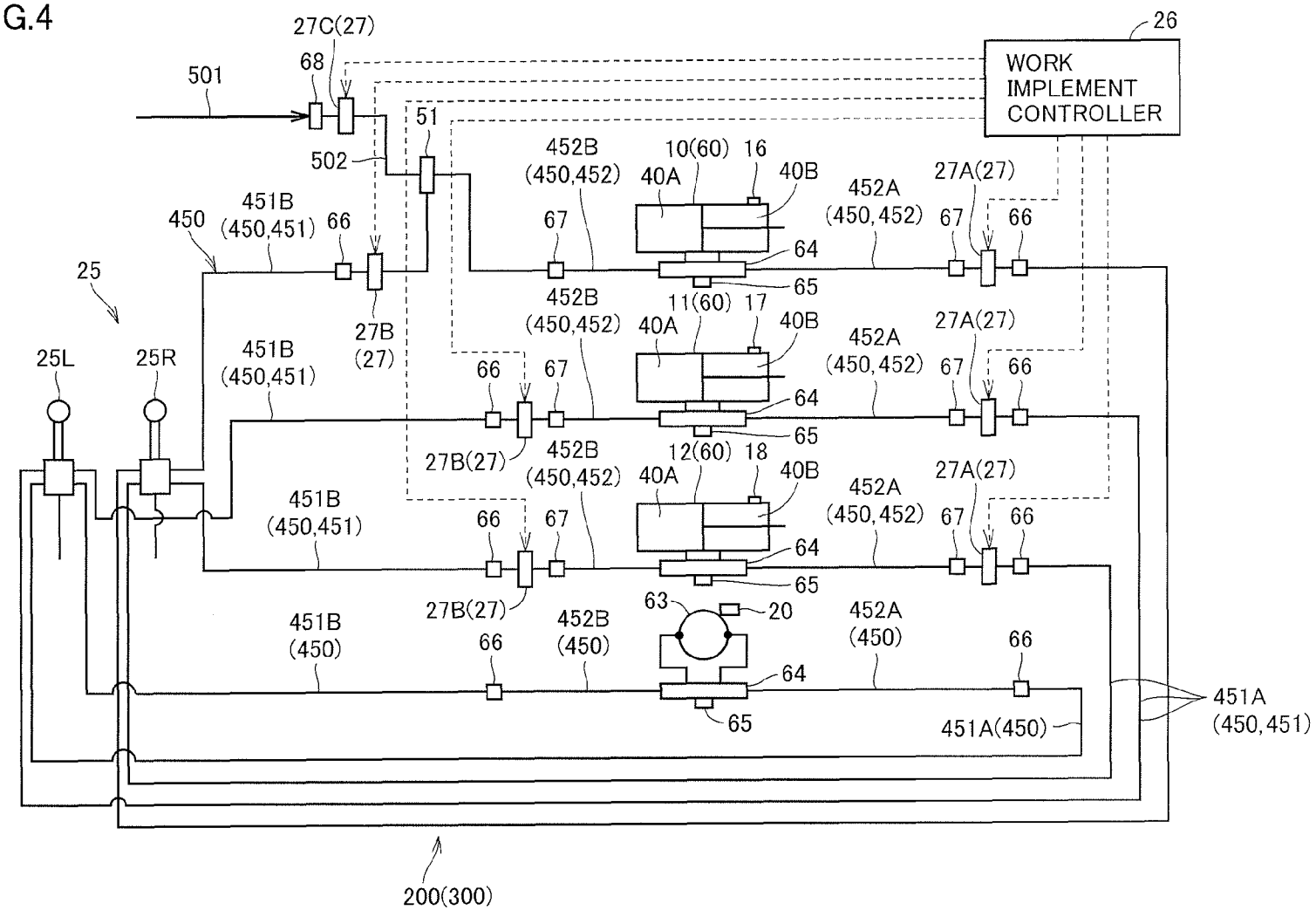
FIG. 4 is a diagram illustrating a configuration of a hydraulic system based on the embodiment.

FIG. 4 is a diagram illustrating a configuration of a hydraulic system based on the embodiment.

As shown in FIG. 4, a hydraulic system 300 includes boom cylinder 10, arm cylinder 11, and bucket cylinder 12 (a plurality of hydraulic cylinders 60) as well as a revolution motor 63 revolving revolving unit 3. Here, boom cylinder 10 is also denoted as hydraulic cylinder 10 (60), which is also applicable to other hydraulic cylinders.

Hydraulic cylinder 60 operates with a hydraulic oil supplied from a not-shown main hydraulic pump. Revolution motor 63 is a hydraulic motor and operates with the hydraulic oil supplied from the main hydraulic pump.

In the present example, direction control valve 64 controlling a direction of flow and a flow rate of the hydraulic oil is provided for each hydraulic cylinder 60. The hydraulic oil supplied from the main hydraulic pump is supplied to each hydraulic cylinder 60 through direction control valve 64. Direction control valve 64 is provided for revolution motor 63.

Each hydraulic cylinder 60 has a cap side (bottom side) oil chamber 40A and a rod side (head side) oil chamber 40B.

Direction control valve 64 is of a spool type in which a direction of flow of the hydraulic oil is switched by moving a rod-shaped spool. As the spool axially moves, switching between supply of the hydraulic oil to cap side oil chamber 40A and supply of the hydraulic oil to rod side oil chamber 40B is made. As the spool axially moves, an amount of supply of the hydraulic oil to hydraulic cylinder 60 (an amount of supply per unit time) is regulated.

As an amount of supply of the hydraulic oil to hydraulic cylinder 60 is regulated, a cylinder speed (a moving speed of a cylinder rod) of hydraulic cylinder 60 is adjusted. By adjusting the cylinder speed, speeds of boom 6, arm 7, and bucket 8 are controlled. In the present example, direction control valve 64 functions as a regulator capable of regulating an amount of supply of the hydraulic oil to hydraulic cylinder 60 driving work implement 2 as the spool moves.

Each direction control valve 64 is provided with a spool stroke sensor 65 detecting a distance of movement of the spool (a spool stroke). A detection signal from spool stroke sensor 65 is output to work implement controller 26.

Drive of each direction control valve 64 is adjusted through operation apparatus 25. In the present example, operation apparatus 25 is an operation apparatus of a pilot hydraulic type as described above.

The pilot oil delivered from the main hydraulic pump, of which pressure has been reduced by the pressure reduction valve, is supplied to operation apparatus 25.

Operation apparatus 25 includes a pilot oil pressure regulation valve. The pilot oil pressure is regulated based on an amount of operation of operation apparatus 25. The pilot oil pressure drives direction control valve 64. As operation apparatus 25 regulates a pilot oil pressure, an amount of movement and a moving speed of the spool in the axial direction are adjusted. Operation apparatus 25 switches between supply of the hydraulic oil to cap side oil chamber 40A and supply of the hydraulic oil to rod side oil chamber 40B.

Operation apparatus 25 and each direction control valve 64 are connected to each other through pilot oil path 450. In the present example, control valve 27, pressure sensor 66, and pressure sensor 67 are arranged in pilot oil path 450.

Pressure sensor 66 and pressure sensor 67 detecting the pilot oil pressure are provided on opposing sides of each control valve 27, respectively. In the present example, pressure sensor 66 is arranged in an oil path 451 between operation apparatus 25 and control valve 27. Pressure sensor 67 is arranged in an oil path 452 between control valve 27 and direction control valve 64. Pressure sensor 66 detects a pilot oil pressure before regulation by control valve 27. Pressure sensor 67 detects a pilot oil pressure regulated by control valve 27. Results of detection by pressure sensor 66 and pressure sensor 67 are output to work implement controller 26.

Control valve 27 regulates a pilot oil pressure based on a control signal (an EPC current) from work implement controller 26. Control valve 27 is a proportional solenoid control valve and is controlled based on a control signal from work implement controller 26. Control valve 27 includes a control valve 27B and a control valve 27A. Control valve 27B regulates a pilot oil pressure of the pilot oil supplied to a second pressure reception chamber of direction control valve 64, so as to be able to regulate an amount of supply of the hydraulic oil supplied to cap side oil chamber 40A through direction control valve 64. Control valve 27A regulates a pilot oil pressure of the pilot oil supplied to a first pressure reception chamber of direction control valve 64, so as to be able to regulate an amount of supply of the hydraulic oil supplied to rod side oil chamber 40B through direction control valve 64.

In the present example, pilot oil path 450 between operation apparatus 25 and control valve 27 of pilot oil path 450 is referred to as oil path (an upstream oil path) 451. Pilot oil path 450 between control valve 27 and direction control valve 64 is referred to as oil path (a downstream oil path) 452.

The pilot oil is supplied to each direction control valve 64 through oil path 452.

Oil path 452 includes an oil path 452A connected to the first pressure reception chamber and an oil path 452B connected to the second pressure reception chamber.

When the pilot oil is supplied through oil path 452B to the second pressure reception chamber of direction control valve 64, the spool moves in accordance with the pilot oil pressure. The hydraulic oil is supplied to cap side oil chamber 40A through direction control valve 64. An amount of supply of the hydraulic oil to cap side oil chamber 40A is regulated based on an amount of movement of the spool in accordance with the amount of operation of operation apparatus 25.

When the pilot oil is supplied through oil path 452A to the first pressure reception chamber of direction control valve 64, the spool moves in accordance with the pilot oil pressure. The hydraulic oil is supplied to rod side oil chamber 40B through direction control valve 64. An amount of supply of the hydraulic oil to rod side oil chamber 40B is regulated based on an amount of movement of the spool in accordance with the amount of operation of operation apparatus 25.

Therefore, as the pilot oil of which pressure is regulated through operation apparatus 25 is supplied to direction control valve 64, a position of the spool in the axial direction is adjusted.

Oil path 451 includes an oil path 451A connecting oil path 452A and operation apparatus 25 to each other and an oil path 451B connecting oil path 452B and operation apparatus 25 to each other.

[As to Operation of Operation Apparatus 25 and Operation of Hydraulic System]

As described above, as operation apparatus 25 is operated, boom 6 performs two types of operations of a lowering operation and a raising operation.

As operation apparatus 25 is operated to perform the operation for raising boom 6, the pilot oil is supplied through oil path 451A and oil path 452A to direction control valve 64 connected to boom cylinder 10.

Thus, the hydraulic oil from the main hydraulic pump is supplied to boom cylinder 10 and the operation for raising boom 6 is performed.

As operation apparatus 25 is operated to perform the operation for raising boom 6, the pilot oil is supplied through oil path 451B and oil path 452B to direction control valve 64 connected to boom cylinder 10. Direction control valve 64 operates based on a pilot oil pressure.

Thus, the hydraulic oil from the main hydraulic pump is supplied to boom cylinder 10 and the operation for raising boom 6 is performed.

In the present example, as boom cylinder 10 contracts, boom 6 performs the lowering operation, and as boom cylinder 10 extends, boom 6 performs the raising operation. As the hydraulic oil is supplied to rod side oil chamber 40B of boom cylinder 10, boom cylinder 10 contracts and boom 6 performs the lowering operation. As the hydraulic oil is supplied to cap side oil chamber 40A of boom cylinder 10, boom cylinder 10 extends and boom 6 performs the raising operation.

As operation apparatus 25 is operated, arm 7 performs two types of operations of a lowering operation and a raising operation.

As operation apparatus 25 is operated to perform the operation for lowering arm 7, the pilot oil is supplied through oil path 451B and oil path 452B to direction control valve 64 connected to arm cylinder 11.

Thus, the hydraulic oil from the main hydraulic pump is supplied to arm cylinder 11 and the operation for lowering arm 7 is performed.

As operation apparatus 25 is operated to perform the operation for raising arm 7, the pilot oil is supplied through oil path 451A and oil path 452A to direction control valve 64 connected to arm cylinder 11.

Thus, the hydraulic oil from the main hydraulic pump is supplied to arm cylinder 11 and the operation for raising arm 7 is performed.

In the present example, as arm cylinder 11 extends, arm 7 performs the lowering operation (an excavation operation), and as arm cylinder 11 contracts, arm 7 performs the raising operation (a dumping operation). As the hydraulic oil is supplied to cap side oil chamber 40A of arm cylinder 11, arm cylinder 11 extends and arm 7 performs the lowering operation. As the hydraulic oil is supplied to rod side oil chamber 40B of arm cylinder 11, arm cylinder 11 contracts and arm 7 performs the raising operation.

As operation apparatus 25 is operated, bucket 8 performs two types of operations of a lowering operation and a raising operation.

As operation apparatus 25 is operated to perform the operation for lowering bucket 8, the pilot oil is supplied through oil path 451B and oil path 452B to direction control valve 64 connected to bucket cylinder 12.

Thus, the hydraulic oil from the main hydraulic pump is supplied to bucket cylinder 12 and the operation for lowering bucket 8 is performed.

As operation apparatus 25 is operated to perform the operation for raising bucket 8, the pilot oil is supplied through oil path 451A and oil path 452A to direction control valve 64 connected to bucket cylinder 12. Direction control valve 64 operates based on the pilot oil pressure.

Thus, the hydraulic oil from the main hydraulic pump is supplied to bucket cylinder 12 and the operation for raising bucket 8 is performed.

In the present example, as bucket cylinder 12 extends, bucket 8 performs the lowering operation (an excavation operation), and as bucket cylinder 12 contracts, bucket 8 performs the raising operation (a dumping operation). As the hydraulic oil is supplied to cap side oil chamber 40A of bucket cylinder 12, bucket cylinder 12 extends and bucket 8 performs the lowering operation. As the hydraulic oil is supplied to rod side oil chamber 40B of bucket cylinder 12, bucket cylinder 12 contracts and bucket 8 performs the raising operation.

As operation apparatus 25 is operated, revolving unit 3 performs two types of operations of an operation for revolving to the right and an operation for revolving to the left.

As operation apparatus 25 is operated to perform the operation for revolving unit 3 to revolve to the right, the hydraulic oil is supplied to revolution motor 63. As operation apparatus 25 is operated to perform the operation for revolving unit 3 to revolve to the left, the hydraulic oil is supplied to revolution motor 63.

<As to Normal Control and Automatic Control (Stop Control) and Operation of Hydraulic System>

Normal control in which no automatic control (stop control) is carried out will initially be described.

In the case of normal control, work implement 2 operates in accordance with an amount of operation of operation apparatus 25.

Specifically, as shown in FIG. 4, work implement controller 26 causes control valve 27 to open. By opening control valve 27, the pilot oil pressure of oil path 451 and the pilot oil pressure of oil path 452 are equal to each other. While control valve 27 is open, the pilot oil pressure (a PPC pressure) is regulated based on the amount of operation of operation apparatus 25. Thus, direction control valve 64 is regulated, and the operation for lowering boom 6 and bucket 8 described above can be performed.

Automatic control (stop control) will now be described.

In the case of automatic control (stop control), work implement 2 is controlled by work implement controller 26 based on an operation of operation apparatus 25.

Specifically, as shown in FIG. 4, work implement controller 26 outputs a control signal to control valve 27. Oil path 451 has a prescribed pressure, for example, owing to an action of a pilot oil pressure regulation valve.

Control valve 27 operates based on a control signal from work implement controller 26. The hydraulic oil in oil path 451 is supplied to oil path 452 through control valve 27. Therefore, a pressure of the hydraulic oil in oil path 452 can be regulated (reduced) by means of control valve 27.

A pressure of the hydraulic oil in oil path 452 is applied to direction control valve 64. Thus, direction control valve 64 operates based on the pilot oil pressure controlled by control valve 27.

For example, work implement controller 26 can regulate a pilot oil pressure applied to direction control valve 64 connected to boom cylinder 10 by outputting a control signal to at least one of control valve 27A and control valve 27B. As the hydraulic oil of which pressure is regulated by control valve 27A is supplied to direction control valve 64, the spool axially moves toward one side. As the hydraulic oil of which pressure is regulated by control valve 27B is supplied to direction control valve 64, the spool axially moves toward the other side. Thus, a position of the spool in the axial direction is adjusted.

Furthermore, work implement controller 26 can regulate a pilot oil pressure applied to direction control valve 64 connected to boom cylinder 10 by outputting a control signal to a control valve 27C.

Similarly, work implement controller 26 can regulate a pilot oil pressure applied to direction control valve 64 connected to bucket cylinder 12 by outputting a control signal to at least one of control valve 27A and control valve 27B.

Figure 5:
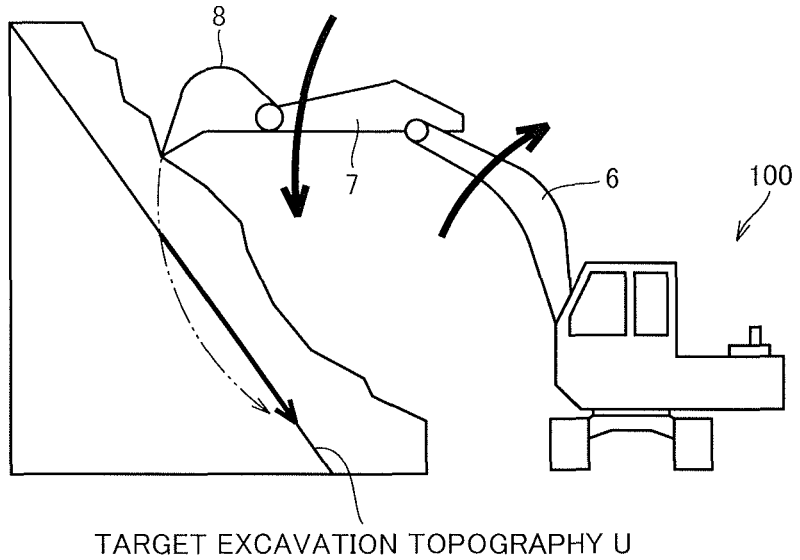
FIG. 5 is a diagram schematically showing one example of an operation of a work implement 2 when stop control based on the embodiment is carried out.

Thus, work implement controller 26 controls movement of boom 6 (stop control) such that cutting edge 8*a* of bucket 8 does not enter target design topography U (FIG. 5).

In the present example, control of a position of boom 6 by outputting a control signal to control valve 27 connected to boom cylinder 10 such that entry of cutting edge 8*a* into target excavation topography U is suppressed is referred to as stop control.

Specifically, work implement controller 26 controls a speed of boom 6 such that a speed at which bucket 8 comes closer to target excavation topography U decreases in accordance with distance d between target excavation topography U and bucket 8, based on target excavation topography U representing target design topography which is an aimed shape of an excavation target and bucket position data S representing a position of cutting edge 8*a* of bucket 8.

Stop control in hydraulic system 300 in the present embodiment is carried out by reducing a speed in lowering boom 6 by carrying out control for closing solenoid valve 27A on a side for lowering boom 6.

An oil path 200 (300) is connected to control valve 27A and supplies a pilot oil to be supplied to direction control valve 64 connected to boom cylinder 10.

Pressure sensor 66 detects a pilot oil pressure of the pilot oil in oil path 200 (300).

Control valve 27A is controlled based on a control signal output from work implement controller 26 for carrying out stop control.

In the present example, work implement controller 26 outputs a control signal so as to close an oil path 501 by means of control valve 27C, such that direction control valve 64 is driven based on the pilot oil pressure regulated in response to the operation of operation apparatus 25 while stop control is not carried out.

Alternatively, work implement controller 26 outputs a control signal to each control valve 27 such that direction control valve 64 is driven based on the pilot oil pressure regulated by control valve 27A while stop control is carried out.

For example, when stop control restricting movement of boom 6 is carried out, work implement controller 26 controls control valve 27A such that the pilot oil pressure output from control valve 27A is lower than the pilot oil pressure regulated through operation apparatus 25.

Oil paths 501 and 502, control valve 27C, a shuttle valve 51, and a pressure sensor 68 are used for automatic raising of the boom during profile control.

<Stop Control>

FIG. 5 is a diagram schematically showing one example of an operation of work implement 2 when stop control based on the embodiment is carried out.

As shown in FIGS. 4 and 5, in stop control, stop control for controlling boom 6 is carried out such that bucket 8 does not enter the target design topography (target excavation topography U). Specifically, hydraulic system 300 controls a speed of boom 6 such that a speed at which bucket 8 comes closer to target excavation topography U is reduced at the time when cutting edge 8*a* of bucket 8 comes closer to target excavation topography U.

Figure 6:
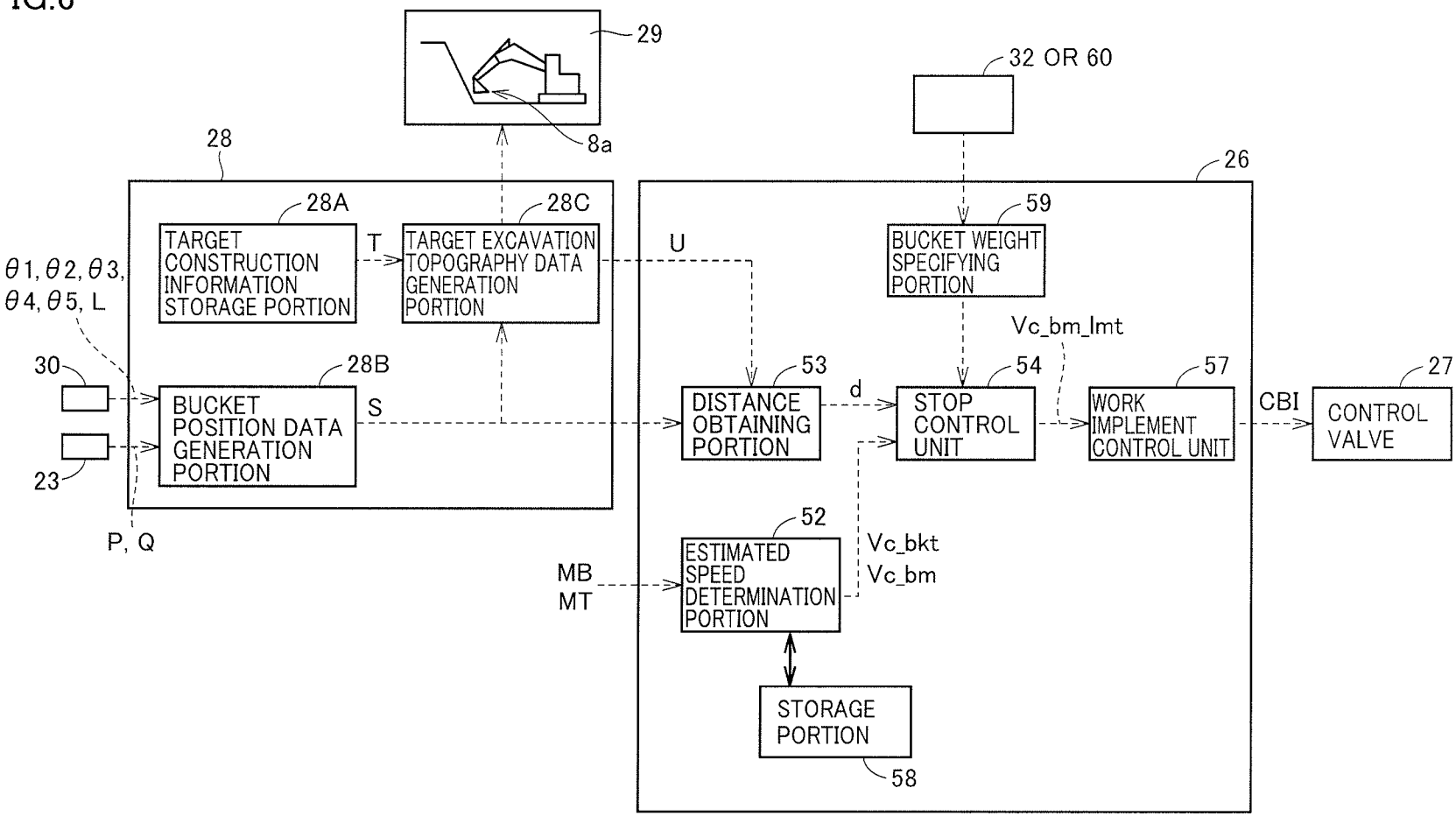
FIG. 6 is a functional block diagram of control system 200 carrying out stop control based on the embodiment.

FIG. 6 is a functional block diagram of control system 200 carrying out stop control based on the embodiment.

As shown in FIG. 6, a functional block of work implement controller 26 and display controller 28 included in control system 200 is shown.

Here, stop control of boom 6 will be described. As described above, stop control is control of movement of boom 6 such that cutting edge 8*a* of bucket 8 does not enter target excavation topography U at the time when cutting edge 8*a* of bucket 8 comes closer to target excavation topography U from above target excavation topography U as a result of a boom lowering operation by the operator.

Specifically, work implement controller 26 calculates distance d between target excavation topography U and bucket 8 based on target excavation topography U representing the target design topography which is an aimed shape of an excavation target and bucket position data S representing a position of cutting edge 8*a* of bucket 8. Then, a control signal CBI to control valve 27 based on stop control of boom 6 is output such that a speed at which bucket 8 comes closer to target excavation topography U decreases in accordance with distance d.

Initially, work implement controller 26 calculates a speed of cutting edge 8*a* of the bucket in the operation of boom 6 and bucket 8 based on an operation command resulting from the operation of operation apparatus 25. Then, a boom speed limit (a target speed) for controlling a speed of boom 6 is calculated based on the result of calculation, such that cutting edge 8*a* of bucket 8 does not enter target excavation topography U. Then, control signal CBI to control valve 27 is output such that boom 6 operates at the boom speed limit.

The functional block will specifically be described below with reference to FIG. 6.

As shown in FIG. 6, display controller 28 has a target construction information storage portion 28A, a bucket position data generation portion 28B, and a target excavation topography data generation portion 28C. Display controller 28 can calculate a position of a local coordinate when viewed in the global coordinate system, based on a result of detection by position detection apparatus 20.

Display controller 28 receives an input from sensor controller 30.

Sensor controller 30 obtains cylinder length data L and angles of inclination θ1, θ2, and θ3 from a result of detection by cylinder stroke sensors 16, 17, and 18. Sensor controller 30 obtains data on angle of inclination θ4 and data on angle of inclination θ5 output from IMU 24. Sensor controller 30 outputs to display controller 28, cylinder length data L, data on angles of inclination θ1, θ2, and θ3, as well as data on angle of inclination θ4 and data on angle of inclination θ5.

As described above, in the present example, the result of detection by cylinder stroke sensors 16, 17, and 18 and the result of detection by IMU 24 are output to sensor controller 30 and sensor controller 30 performs prescribed operation processing.

In the present example, a function of sensor controller 30 may be performed by work implement controller 26 instead. For example, results of detection by cylinder stroke sensors 16, 17, and 18 may be output to work implement controller 26, and work implement controller 26 may calculate a cylinder length (a boom cylinder length, an arm cylinder length, and a bucket cylinder length) based on results of detection by cylinder stroke sensors 16, 17, and 18. A result of detection by IMU 24 may be output to work implement controller 26.

Global coordinate operation portion 23 obtains reference position data P and revolving unit orientation data Q and outputs them to display controller 28.

Target construction information storage portion 28A stores target construction information (three-dimensional design topography data) T representing three-dimensional design topography which is an aimed shape of an area of working. Target construction information T has coordinate data and angle data necessary for generation of target excavation topography (design topography data) U representing the design topography which is an aimed shape of an excavation target. Target construction information T may be supplied to display controller 28, for example, through a radio communication apparatus.

Bucket position data generation portion 28B generates bucket position data S representing a three-dimensional position of bucket 8 based on angles of inclination θ1, θ2, θ3, θ4, and θ5, reference position data P, revolving unit orientation data Q, and cylinder length data L. Information on a position of cutting edge 8*a* may be transferred from a connection type recording device such as a memory.

In the present example, bucket position data S is data representing a three-dimensional position of cutting edge 8*a*.

Target excavation topography data generation portion 28C generates target excavation topography U representing an aimed shape of an excavation target, by using bucket position data S obtained from bucket position data generation portion 28B and target construction information T stored in target construction information storage portion 28A, which will be described later.

Target excavation topography data generation portion 28C outputs data on generated target excavation topography U to display portion 29. Thus, display portion 29 displays the target excavation topography.

Display portion 29 is implemented, for example, by a monitor, and displays various types of information on work vehicle 100. In the present example, display portion 29 has a human-machine interface (HMI) monitor as a guidance monitor for information-oriented construction.

Target excavation topography data generation portion 28C outputs data on target excavation topography U to work implement controller 26. Bucket position data generation portion 28B outputs generated bucket position data S to work implement controller 26.

Work implement controller 26 has an estimated speed determination portion 52, a distance obtaining portion 53, a stop control unit 54, a work implement control unit 57, a storage portion 58, and a bucket weight specifying portion 59.

Work implement controller 26 obtains an operation command (pressures MB and NIT) from operation apparatus 25 as well as bucket position data S and target excavation topography U from display controller 28, and outputs control signal CBI for control valve 27. Work implement controller 26 obtains various parameters necessary for operation processing from sensor controller 30 and global coordinate operation portion 23 as necessary. Work implement controller 26 obtains a weight of bucket 8 from man-machine interface portion 32 (or hydraulic cylinder 60).

Estimated speed determination portion 52 calculates a boom estimated speed Vc_bm and a bucket estimated speed Vc_bkt corresponding to an operation of a lever of operation apparatus 25 for driving boom 6 and bucket 8.

Here, boom estimated speed Vc_bm refers to a speed of cutting edge 8*a* of bucket 8 in a case that only boom cylinder 10 is driven. Bucket estimated speed Vc_bkt refers to a speed of cutting edge 8*a* of bucket 8 in a case that only bucket cylinder 12 is driven.

Estimated speed determination portion 52 calculates boom estimated speed Vc_bm corresponding to a boom operation command (pressure MB). Similarly, estimated speed determination portion 52 calculates bucket estimated speed Vc_bkt corresponding to a bucket operation command (pressure MT). Thus, a speed of cutting edge 8*a* of bucket 8 corresponding to each operation command can be calculated.

Storage portion 58 stores data such as various tables for estimated speed determination portion 52 to perform operation processing.

Distance obtaining portion 53 obtains data on target excavation topography U from target excavation topography data generation portion 28C. Distance obtaining portion 53 obtains bucket position data. S representing a position of cutting edge 8*a* of bucket 8 from bucket position data generation portion 28B. Distance obtaining portion 53 calculates distance d between cutting edge 8*a* of bucket 8 in a direction perpendicular to target excavation topography U and target excavation topography U, based on bucket position data S and target excavation topography U.

Bucket weight specifying portion 59 obtains a weight of bucket 8 selected by the operator in man-machine interface portion 32. When bucket weight specifying portion 59 obtains a weight of bucket 8 selected by the operator, it outputs the weight of bucket 8 to stop control unit 54.

Figure 7:
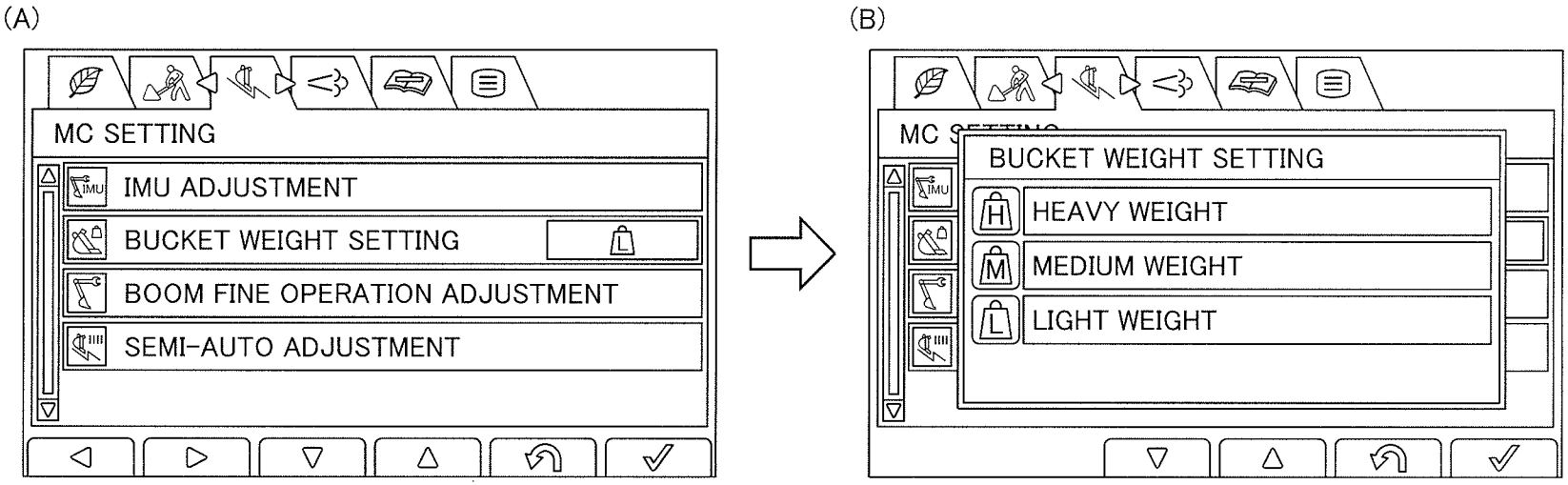
FIGS. 7 (A) and 7 (B) are diagrams each showing a display screen of a display portion 322 when an operator inputs a bucket weight based on the embodiment.

Input of a bucket weight into man-machine interface portion 32 by the operator may be provided through an input operation onto input portion 321, or in a case that display portion 322 is implemented by a touch panel, it may be provided through an input operation onto display portion 322. At the time of selection of a weight of bucket 8 by the operator, for example as shown in FIG. 7 (A), an item of "bucket weight setting" is displayed. When the operator selects the item "bucket weight setting," for example as shown in FIG. 7 (B), display portion 322 displays items "heavy weight", "medium weight", and "light weight" in accordance with a weight of bucket 8. When the operator selects any item from "heavy weight", "medium weight", and "light weight", a weight of bucket 8 is selected.

Alternatively, a weight of bucket 8 may automatically be sensed based on a pressure generated in hydraulic cylinder 60 (boom cylinder 10, arm cylinder 11, and bucket cylinder 12) unless it is manually selected by the operator. In this case, for example, while work vehicle 100 is in a specific orientation and bucket 8 is in the air, a pressure generated in hydraulic cylinder 60 is sensed. The sensed pressure in hydraulic cylinder 60 is input, for example, to bucket weight specifying portion 59. Bucket weight specifying portion 59 specifies a weight of bucket 8 attached to arm 7 based on the input pressure in hydraulic cylinder 60.

A function to specify a bucket weight by bucket weight specifying portion 59 may be performed by man-machine interface portion 32 or stop control unit 54. In this case, it is not necessary to provide bucket weight specifying portion 59.

Figure 8:
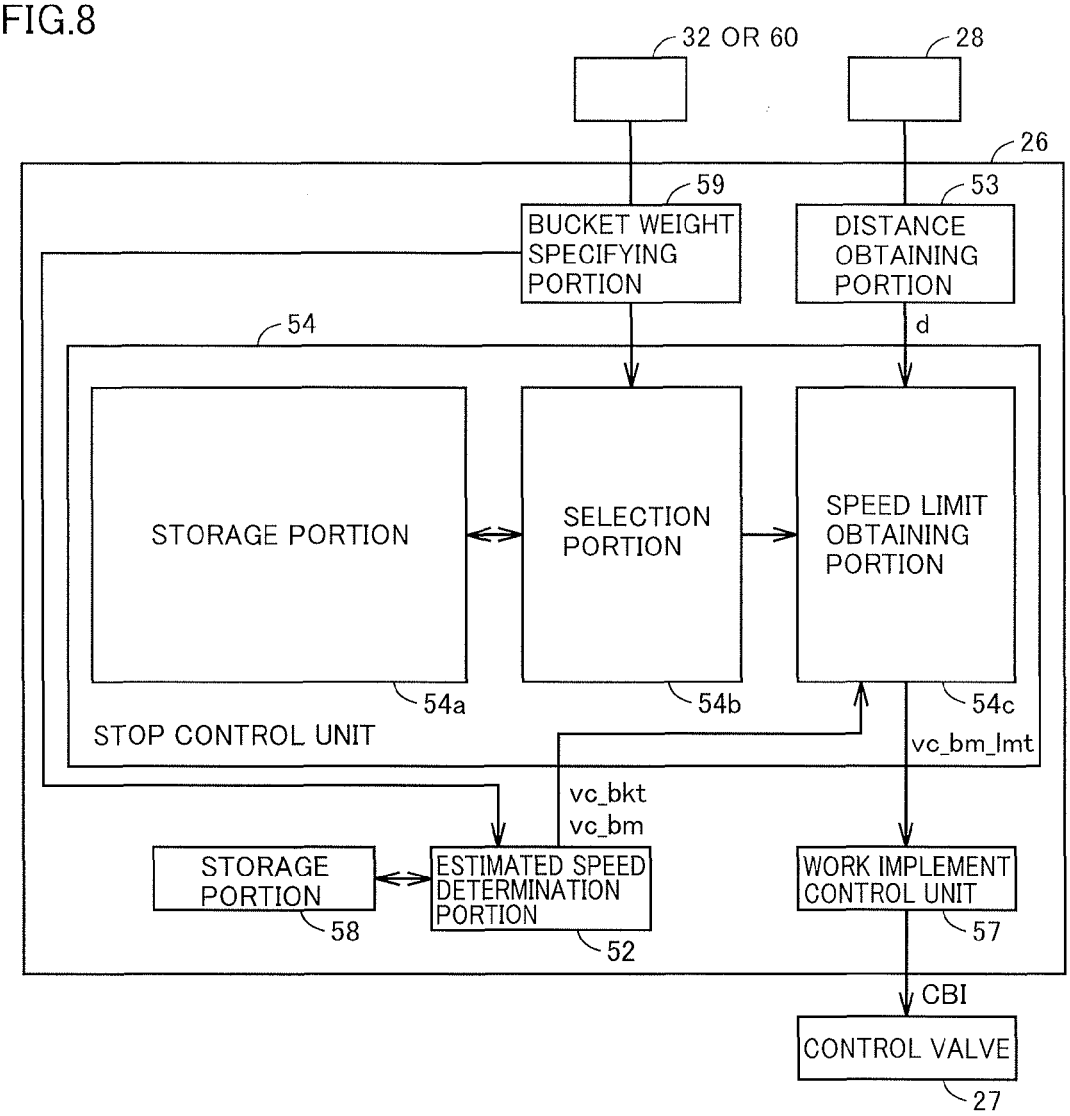
FIG. 8 is a functional block diagram of a stop control unit 54 of control system 200 shown in FIG. 6.

Stop control unit 54 carries out stop control in which an operation of work implement 2 is stopped before cutting edge 8*a* of bucket 8 reaches the target design topography when cutting edge 8*a* of bucket 8 comes closer to the target design topography. As shown in FIG. 8, stop control unit 54 has a storage portion 54*a*, a selection portion 54*b*, and a speed limit obtaining portion 54*c*.

Storage portion 54*a* stores for stop control, a plurality of pieces of relation data corresponding to a plurality of weights of buckets 8, respectively, each piece of relation data defining relation between a speed limit of cutting edge 8*a* of bucket 8 and distance d between cutting edge 8*a* of bucket 8 and the target design topography. Selection portion 54*b* selects one piece of relation data from among the plurality of pieces of relation data stored in storage portion 54*a*, based on the weight of bucket 8 specified by bucket weight specifying portion 59. Selection portion 54*b* outputs selected one piece of relation data to speed limit obtaining portion 54*c*. Speed limit obtaining portion 54*c* obtains a speed limit Vc_lmt of cutting edge 8*a* of bucket 8 based on distance d obtained by distance obtaining portion 53, by using one piece of relation data selected by selection portion 54*b*.

Stop control unit 54 determines a speed limit Vc_bm_lmt of boom 6 based on speed limit Vc_lmt of cutting edge 8*a* of bucket 8 obtained as above and estimated speeds Vc_bm and Vc_bkt obtained from estimated speed determination portion 52. Stop control unit 54 outputs speed limit Vc_bm_lmt to work implement control unit 57.

Work implement control unit 57 obtains boom speed limit Vc_bm_lmt and generates control signal CBI based on that boom speed limit Vc_bm_lmt. Work implement 57 outputs that control signal CBI to control valve 27C.

Control valve 27 connected to boom cylinder 10 is thus controlled and stop control of boom 6 is carried Out.

Storage portion 58 preferably stores for stop control, a plurality of pieces of correlation data corresponding to a plurality of weights of buckets, respectively, each piece of correlation data defining relation between a cylinder speed of hydraulic cylinder 60 and an operation command value for operating hydraulic cylinder 60. An operation command value is at least one of an amount of movement of spool 80, a PPC pressure, and an EPC current. Stop control with the use of this correlation data will be described in detail in a modification below.

Stop control is carried out when boom estimated speed Vc_bm is higher than boom speed limit Vc_bm_lmt restricting cutting edge 8*a* of bucket 8 with respect to target excavation topography U from coming closer to target excavation topography U. Therefore, stop control is not carried out when boom estimated speed Vc_bm is lower than boom speed limit Vc_bm_lmt. Boom speed limit Vc_bm_lmt restricts cutting edge 8*a* of bucket 8 with respect to target excavation topography U from coming closer to target excavation topography U.

[Determination of Estimated Speed]

Figure 9:
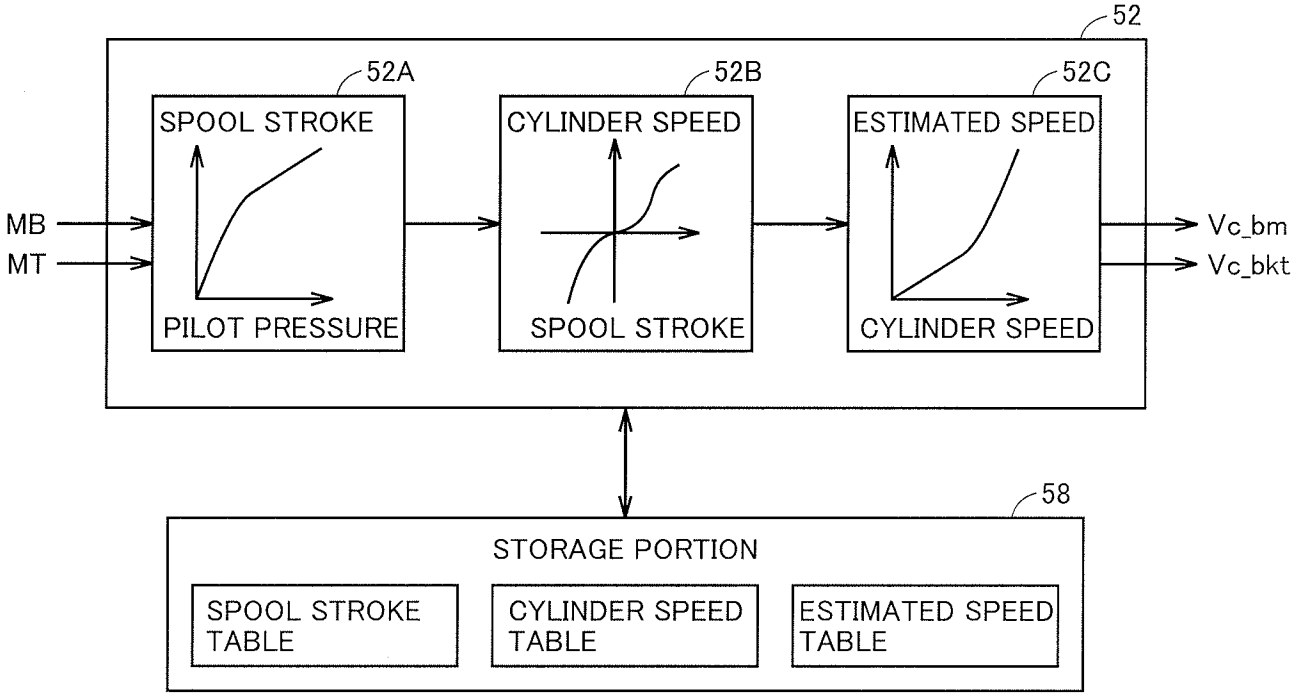
FIG. 9 is a diagram illustrating an operation block illustrating operation processing in an estimated speed determination portion 52 based on the embodiment.

FIG. 9 is diagram illustrating a functional block illustrating operation processing in estimated speed determination portion 52 based on the embodiment.

As shown in FIG. 9, estimated speed determination portion 52 calculates boom estimated speed Vc_bm corresponding to a boom operation command (pressure MB) and bucket estimated speed Vc_bkt corresponding to a bucket operation command (pressure MT). As described above, boom estimated speed Vc_bm refers to a speed of cutting edge 8*a* of bucket 8 in a case that only boom cylinder 10 is driven. Bucket estimated speed Vc_bkt refers to a speed of cutting edge 8*a* of bucket 8 in a case that only bucket cylinder 12 is driven.

Estimated speed determination portion 52 has a spool stroke operation portion 52A, a cylinder speed operation portion 52B, and an estimated speed operation portion 52C.

Spool stroke operation portion 52A calculates an amount of a spool stroke of spool 80 of hydraulic cylinder 60 based on a spool stroke table in accordance with an operation command (pressure) stored in storage portion 58. A pressure of a pilot oil for moving spool 80 is also referred to as a PPC pressure.

An amount of movement of spool 80 is adjusted by a pressure of oil path 452 (pilot oil pressure) controlled by operation apparatus 25 or by means of control valve 27. The pilot oil pressure of oil path 452 is a pressure of the pilot oil in oil path 452 for moving the spool and regulated by operation apparatus 25 or by means of control valve 27. Therefore, an amount of movement of the spool (a spool stroke) and a PPC pressure correlate with each other.

Cylinder speed operation portion 52B calculates a cylinder speed of hydraulic cylinder 60 based on a cylinder speed table in accordance with the calculated amount of the spool stroke.

A cylinder speed of hydraulic cylinder 60 is adjusted based on an amount of supply of the hydraulic oil per unit time, which is supplied from the main hydraulic pump through direction control valve 64. Direction control valve 64 has movable spool 80. An amount of supply of the hydraulic oil per unit time to hydraulic cylinder 60 is adjusted based on an amount of movement of spool 80. Therefore, a cylinder speed and an amount of movement of the spool (a spool stroke) correlate with each other.

Estimated speed operation portion 52C calculates an estimated speed based on an estimated speed table in accordance with the calculated cylinder speed of hydraulic cylinder 60.

Since work implement 2 (boom 6, arm 7, and bucket 8) operates in accordance with a cylinder speed of hydraulic cylinder 60, a cylinder speed and an estimated speed correlate with each other.

Through the processing above, estimated speed determination portion 52 calculates boom estimated speed Vc_bm corresponding to a boom operation command (pressure MB) and bucket estimated speed Vc_bkt corresponding to a bucket operation command (pressure MT). The spool stroke table, the cylinder speed table, and the estimated speed table are provided for boom 6 and bucket 8 found based on experiments or simulations, and stored in advance in storage portion 58.

A target speed of cutting edge 8*a* of bucket 8 corresponding to each operation command can thus be calculated.

[Conversion of Estimated Speed into Perpendicular Speed Component]

In calculating a boom limit speed, speed components Vcy_bm and Vcy_bkt in a direction perpendicular to the surface of target excavation topography U (perpendicular speed components), of estimated speeds Vc_bm and Vc_bkt of boom 6 and bucket 8 should be calculated, respectively. Therefore, initially, a scheme for calculating perpendicular speed components Vcy_bm and Vcy_bkt will be described.

Figure 10:
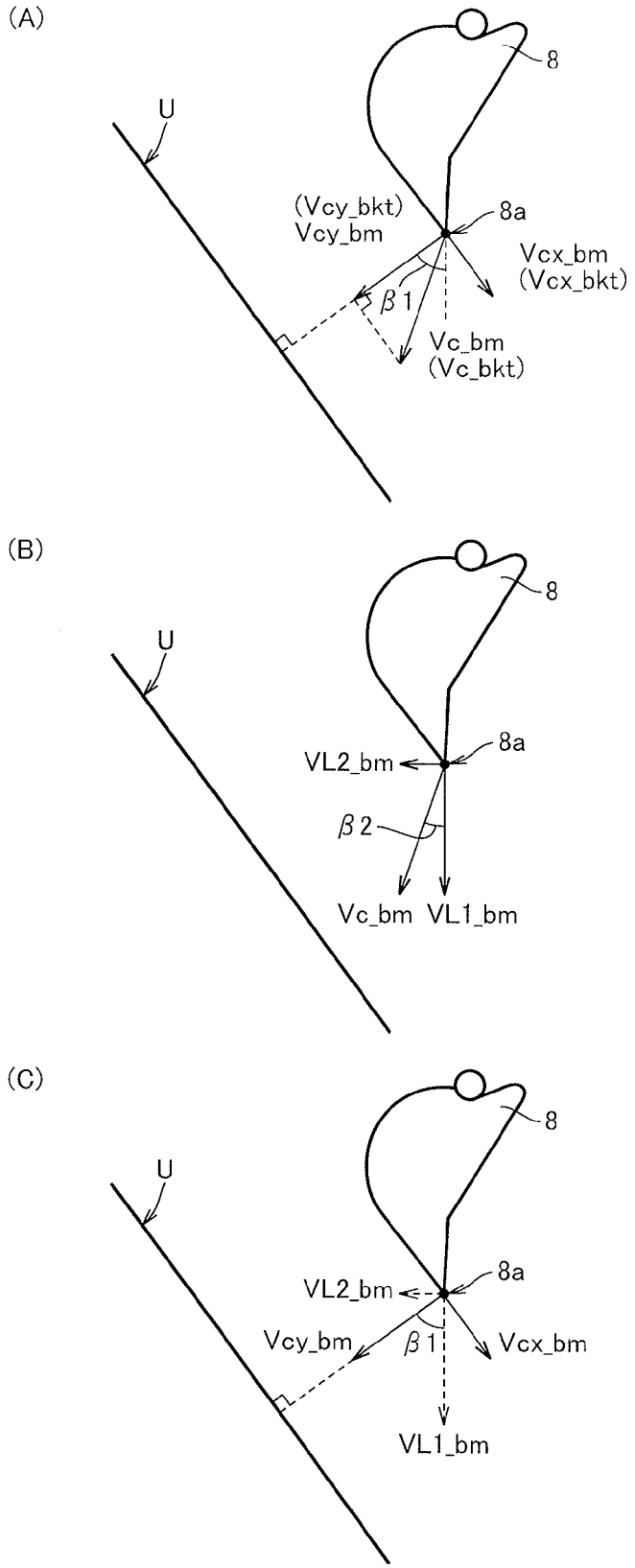
FIGS. 10 (A), 10 (B), and 10 (C) are each a diagram illustrating a scheme for calculating perpendicular speed components Vcy_bm and Vcy_bkt based on the embodiment.

FIGS. 10 (A) to 10 (C) are diagrams illustrating a scheme for calculating perpendicular speed components Vcy_bm and Vcy_bkt based on the present embodiment.

As shown in FIG. 10 (A), stop control unit 54 (FIGS. 6 and 8) converts boom estimated speed Vc_bm into speed component Vcy_bm in a direction perpendicular to the surface of target excavation topography U (a perpendicular speed component) and a speed component Vcx_bm in a direction in parallel to the surface of target excavation topography U (a horizontal speed component).

Here, stop control unit 54 finds an inclination of a perpendicular axis (axis of revolution. AX of revolving unit 3) of the local coordinate system with respect to a perpendicular axis of the global coordinate system and an inclination in a direction perpendicular to the surface of target excavation topography U with respect to the perpendicular axis of the global coordinate system, from an angle of inclination obtained from sensor controller 30 and target excavation topography U. Stop control unit 54 finds an angle β1 representing an inclination between the perpendicular axis of the local coordinate system and the direction perpendicular to the surface of target excavation topography U from these inclinations.

Then, as shown in FIG. 10 (B), stop control unit 54 converts boom estimated speed Vc_bm into a speed component VL1_bm in a direction of the perpendicular axis of the local coordinate system and a speed component VL2_bm in a direction of a horizontal axis based on a trigonometric function, from an angle β2 formed between the perpendicular axis of the local coordinate system and the direction of boom estimated speed Vc_bm.

Then, as shown in FIG. 10 (C), stop control unit 54 converts speed component VL1_bm in the direction of the perpendicular axis of the local coordinate system and speed component VL2_bm in the direction of the horizontal axis into perpendicular speed component Vcy_bm and horizontal speed component Vcx_bm with respect to target excavation topography U based on the trigonometric function, from inclination β1 between the perpendicular axis of the local coordinate system and the direction perpendicular to the surface of target excavation topography U. Similarly, stop control unit 54 converts bucket estimated speed Vc_bkt into perpendicular speed component Vcy_bkt in the direction of the perpendicular axis of the local coordinate system and a horizontal speed component Vcx_bkt.

Perpendicular speed components Vcy_bm and Vcy_bkt are thus calculated.

[Calculation of Distance d Between Cutting Edge 8*a* of Bucket 8 and Target Excavation Topography U]

Figure 11:
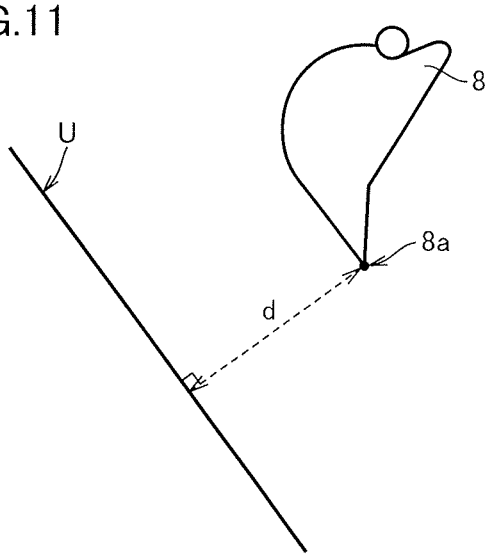
FIG. 11 is a diagram illustrating a distance d shortest between a cutting edge 8*a* of a bucket 8 and a surface of target excavation topography U based on the embodiment.

FIG. 11 is a diagram illustrating obtainment of distance d between cutting edge 8*a* of bucket 8 and target excavation topography U based on the embodiment.

As shown in FIG. 11, distance obtaining portion 53 (FIGS. 6 and 8) calculates distance d shortest between cutting edge 8*a* of bucket 8 and a surface of target excavation topography U based on information on a position of cutting edge 8*a* of bucket 8 (bucket position data S).

In the present example, stop control is carried out based on distance d shortest between cutting edge 8*a* of bucket 8 and the surface of target excavation topography U.

[Flowchart of Stop Control]

Figure 12:
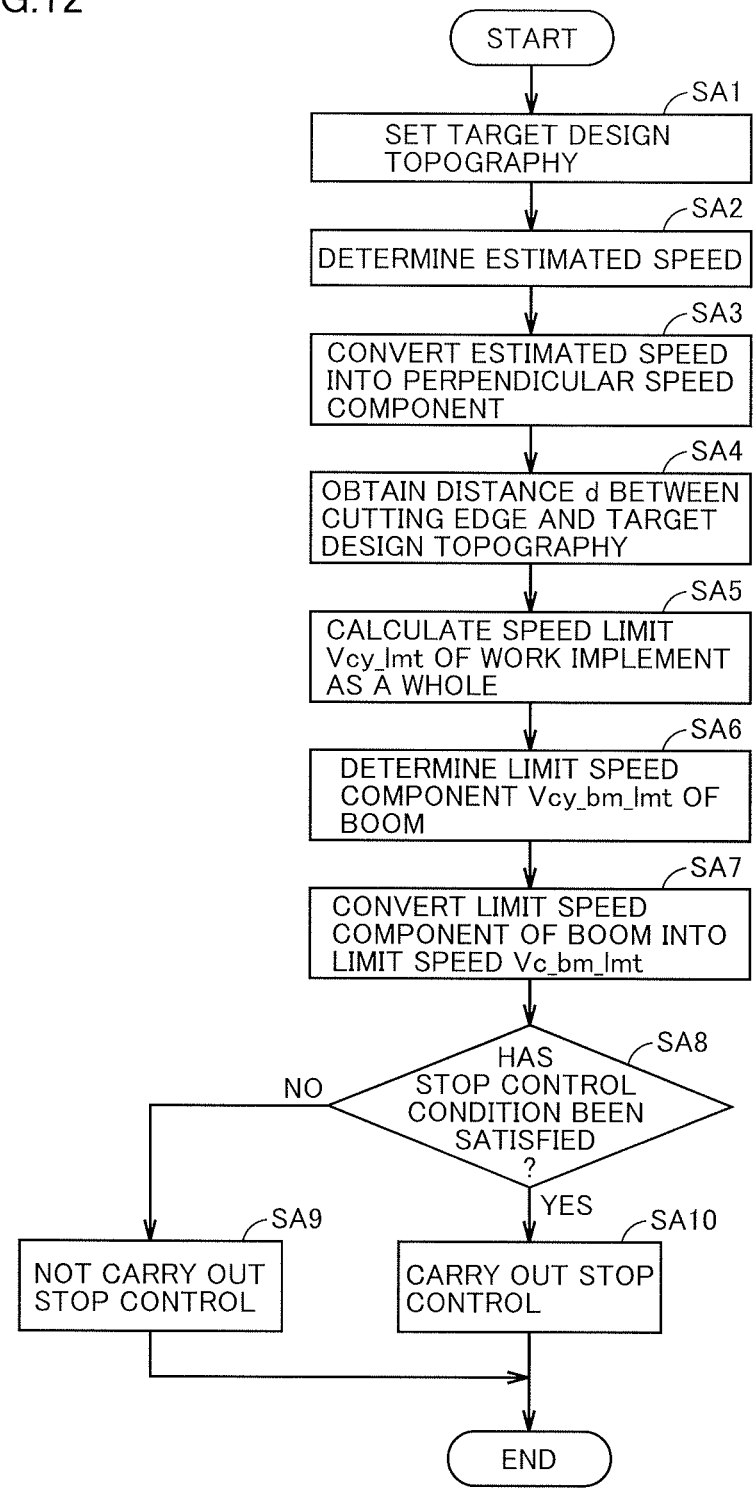
FIG. 12 is a flowchart illustrating stop control of work vehicle 100 based on the embodiment.

FIG. 12 is a flowchart showing one example of stop control. One example of a flow of stop control according to the present embodiment will be described with reference to FIGS. 6 and 9 to 14.

As shown in FIG. 12, initially, target design topography (target excavation topography U) is set (step SA1: FIG. 12).

After target excavation topography U is set, as shown in FIG. 6, work implement controller 26 determines estimated speed Vc of work implement 2 (step SA2: FIG. 12). Estimated speed Vc of work implement 2 includes boom estimated speed Vc_bm and bucket estimated speed Vc_bkt. Boom estimated speed Vc_bm is calculated based on an amount of operation of the boom. Bucket estimated speed Vc_bkt is calculated based on an amount of operation of the bucket.

Storage portion 58 of work implement controller 26 stores estimated speed information defining relation between an amount of operation of the boom and boom estimated speed Vc_bm as shown in FIG. 9. Work implement controller 26 determines boom estimated speed Vc_bm corresponding to an amount of operation of the boom based on estimated speed information. The estimated speed information is, for example, a map in which magnitude of boom estimated speed Vc_bm with respect to an amount of operation of the boom is described. The estimated speed information may be in a form of a table or a mathematical expression.

The estimated speed information includes information defining relation between an amount of operation of the bucket and bucket estimated speed Vc_bkt. Work implement controller 26 determines bucket estimated speed Vc_bkt corresponding to an amount of operation of the bucket based on the estimated speed information.

As shown in FIG. 10 (A), work implement controller 26 converts boom estimated speed Vc_bm into speed component Vcy_bm in the direction perpendicular to the surface of target excavation topography U (the perpendicular speed component) and speed component Vcx_bm in the direction in parallel to the surface of target excavation topography U (the horizontal speed component) (step SA3: FIG. 12).

Work implement controller 26 finds an inclination of the perpendicular axis (axis of revolution AX of revolving unit 3) of the local coordinate system with respect to the perpendicular axis of the global coordinate system and an inclination in the direction perpendicular to the surface of target excavation topography U with respect to the perpendicular axis of the global coordinate system, from reference position data P and target excavation topography U. Work implement controller 26 finds angle β1 representing an inclination between the perpendicular axis of the local coordinate system and the direction perpendicular to the surface of target excavation topography U from these inclinations.

As shown in FIG. 10 (B), work implement controller 26 converts boom estimated speed Vc_bm into speed component VL1_bm in the direction of the perpendicular axis of the local coordinate system and speed component VL2_bm in the direction of the horizontal axis based on a trigonometric function, from angle β2 formed between the perpendicular axis of the local coordinate system and the direction of boom estimated speed Vc_bm.

As shown in FIG. 10 (C), work implement controller 26 converts speed component VL1_bm in the direction of the perpendicular axis of the local coordinate system and speed component VL2_bm in the direction of the horizontal axis into perpendicular speed component Vcy_bin and horizontal speed component Vcx_bm with respect to target excavation topography U based on the trigonometric function, from inclination β1 between the perpendicular axis of the local coordinate system and the direction perpendicular to the surface of target excavation topography U. Similarly, work implement controller 26 converts bucket estimated speed Vc_bkt into perpendicular speed component Vcy_bkt in the direction of the perpendicular axis of the local coordinate system and horizontal speed component Vcx_bkt.

As shown in FIG. 11, work implement controller 26 obtains distance d between cutting edge 8*a* of bucket 8 and target excavation topography U (step SA4: FIG. 12). Work implement controller 26 calculates distance d shortest between cutting edge 8*a* of bucket 8 and the surface of target excavation topography U based on information on a position of cutting edge 8*a* and target excavation topography U. In the present embodiment, stop control is carried out based on distance d shortest between cutting edge 8*a* of bucket 8 and the surface of target excavation topography U.

Work implement controller 26 calculates speed limit Vcy_lmt of work implement 2 as a whole based on distance d between cutting edge 8*a* of bucket 8 and the surface of target excavation topography U (step SA5: FIG. 12). Speed limit Vcy_lmt of work implement 2 as a whole is a moving speed of cutting edge 8*a* allowable in a direction in which cutting edge 8*a* of bucket 8 comes closer to target excavation topography U (also referred to as an allowable speed or a cutting edge speed limit). Storage portion 54*a* of work implement controller 26 stores speed limit information defining relation between distance d and speed limit Vcy_lmt. Speed limit Vcy_lmt of work implement 2 as a whole is calculated from this speed limit information and distance d calculated as above.

The speed limit information used in calculation of speed limit Vcy_lmt is a cutting edge speed limit table of work implement 2 as a whole. The cutting edge speed limit table of work implement 2 as a whole will be described with reference to FIGS. 13 (A) and 13 (B).

Figure 13:
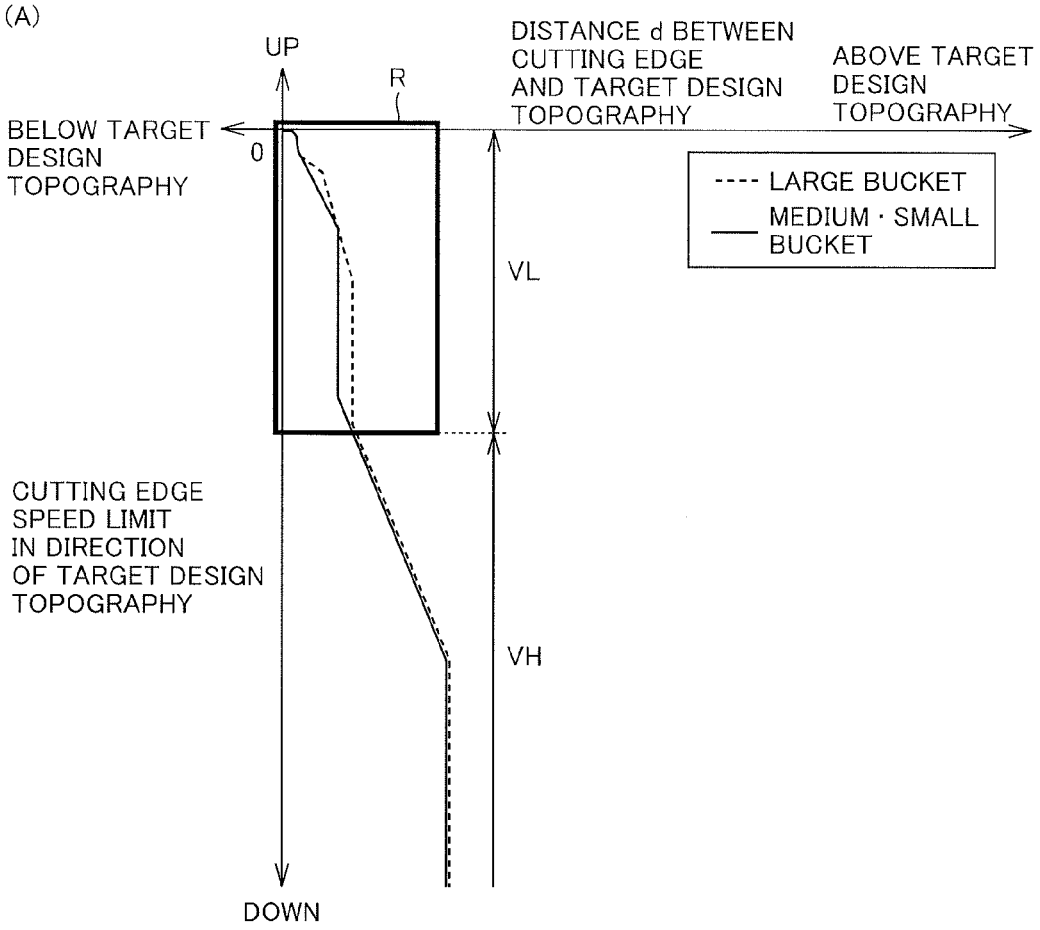
FIGS. 13 (A) and 13 (B) are a diagram illustrating one example of a cutting edge speed limit table of work implement 2 as a whole in stop control based on the embodiment and a diagram showing in an enlarged manner, a region R in FIG. 13 (A), respectively.
Figure 13:
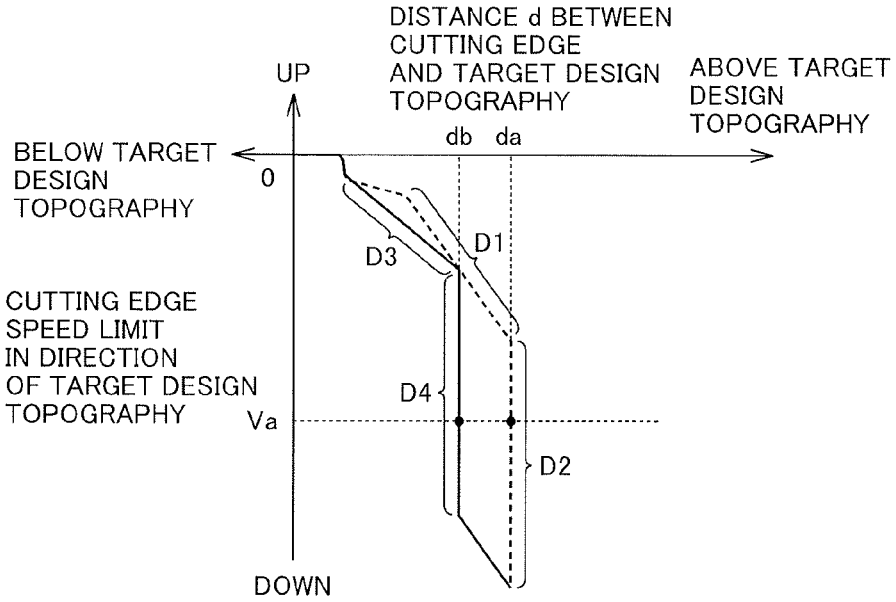

FIG. 13 (A) is a diagram illustrating one example of the cutting edge speed limit table of work implement 2 as a whole in stop control based on the embodiment. FIG. 13 (B) is a diagram showing in an enlarged manner, a region R in FIG. 13 (A).

As shown in FIGS. 13 (A) and 13 (B), here, the ordinate represents a cutting edge speed limit in a direction of the target design topography and the abscissa represents distance d between the cutting edge and the target design topography. Such a cutting edge speed limit table of work implement 2 as a whole is stored, for example, in storage portion 54*a* (FIG. 8) of stop control unit 54.

A plurality of cutting edge speed limit tables in accordance with a weight of bucket 8 are stored in storage portion 54*a*. In the present embodiment, for example, two cutting edge speed limit tables of a cutting edge speed limit table for a large bucket relatively large in weight (first relation data) and a cutting edge speed limit table for medium•small buckets relatively small in weight (second relation data) are stored in storage portion 54*a*. The cutting edge speed limit table for a large bucket is shown with a dashed line and the cutting edge speed limit table for medium•small buckets is shown with a solid line.

The number of cutting edge speed limit tables stored in storage portion 54*a* is not limited to two, and three, or four or more cutting edge speed limit tables may be prepared in correspondence with a large bucket, a medium bucket, and a small bucket.

As shown in FIG. 13 (A), a cutting edge speed limit in a direction of the target design topography has a high speed region VH and a low speed region VL (corresponding to region R). In high speed region VH, the cutting edge speed limit for large bucket 8 and the cutting edge speed limit for medium•small buckets 8 are the same. In low speed region VL, the cutting edge speed limit of large bucket 8 and the cutting edge speed limit for medium•small buckets 8 are different from each other.

In this low speed region VL, when a speed of cutting edge 8*a* of bucket 8 is the same speed Va as shown with a chain double dotted line between a case of large bucket 8 (a first specifying state) and a case of medium•small buckets 8 (a second specifying state), a distance da at which deceleration of cutting edge 8*a* is started in the cutting edge speed limit table for a large bucket shown with the dashed line is larger than a distance db at which deceleration of cutting edge 8*a* is started in the cutting edge speed limit table for medium•small buckets. When a speed of cutting edge 8*a* is the same between use of large bucket 8 and use of medium•small buckets 8 in a case that cutting edge 8*a* of bucket 8 moves from above the target design topography toward the target design topography, deceleration control for alignment with the target design topography is started at a position more distant from the target design topography in the case of large bucket 8 than in the case of medium•small buckets 8.

In region R shown in FIG. 13 (B), the cutting edge speed limit table for a large bucket has a first deceleration section D1 and a second deceleration section D2. First deceleration section D1 is set at a position closer to the target design topography (distance d=0) than second deceleration section D2. A degree of deceleration with change (decrease) in distance d between cutting edge 8*a* and the target design topography in second deceleration section D2 is set to be larger than a degree of deceleration with change (decrease) in distance d between cutting edge 8*a* and the target design topography in first deceleration section D1.

The cutting edge speed limit table for medium•small buckets has a third deceleration section D3 and a fourth deceleration section D4. Third deceleration section D3 is set at a position closer to the target design topography than fourth deceleration section. D4. A degree of deceleration with change (decrease) in distance d between cutting edge 8*a* and the target design topography in fourth deceleration section D4 is set to be larger than a degree of deceleration with change (decrease) in distance d between cutting edge 8*a* and the target design topography in third deceleration section D3.

Third deceleration section D3 in the cutting edge speed limit table for medium•small buckets is set at a position closer to the target design topography than first deceleration section D1 in the cutting edge speed limit table for a large bucket. Fourth deceleration section D4 in the cutting edge speed limit table for medium•small buckets is set at a position closer to the target design topography than second deceleration section D2 in the cutting edge speed limit table for a large bucket.

A stop control method with the use of the cutting edge speed limit table above is as follows.

Figure 14:
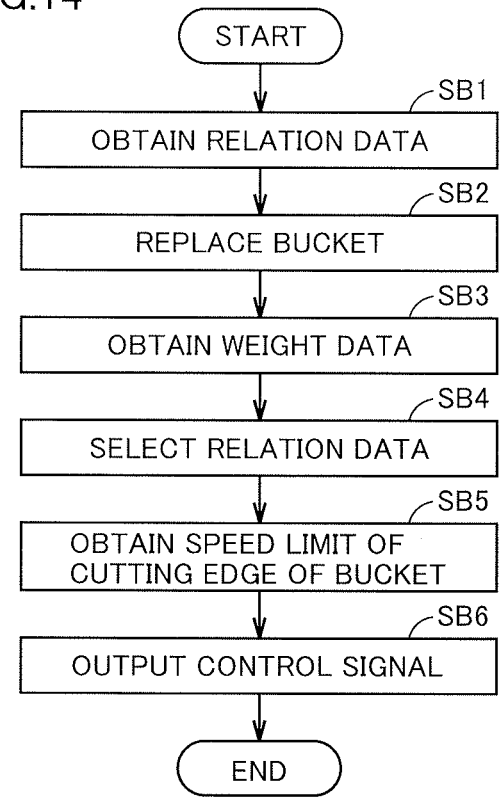
FIG. 14 is a flowchart for illustrating a stop control method with the use of the cutting edge speed limit table based on the embodiment.

FIG. 14 is a flowchart for illustrating the stop control method with the use of the cutting edge speed limit table.

As shown in FIGS. 14 and 8, a plurality of pieces of relation data (the cutting edge speed limit table for a large bucket and the cutting edge speed limit table for medium•small buckets shown in FIG. 13) found in accordance with weights of buckets 8 are stored in storage portion 54*a* (step SB1: FIG. 14).

After bucket 8 is replaced (step SB2: FIG. 14), the operator operates man-machine interface portion 32 so that weight data representing a weight of bucket 8 is input to bucket weight specifying portion 59 through input portion 321 or display portion 322. Bucket weight specifying portion 59 thus obtains weight data (step SB3: FIG. 14). Bucket weight specifying portion 59 specifies the weight data and outputs the weight data to selection portion 54*b*.

Selection portion 54*b* selects one piece of relation data corresponding to the weight data from among the plurality of pieces of relation data stored in storage portion 54*a*, based on the weight data (step SB4: FIG. 14). In the present embodiment, one cutting edge speed limit table corresponding to the weight data of bucket 8 is selected, for example, from the cutting edge speed limit table for a large bucket and the cutting edge speed limit table for medium•small buckets as the plurality of pieces of relation data. Selection portion 54*b* outputs the selected relation data to speed limit obtaining portion 54*c*.

As shown in FIG. 6, bucket position data generation portion 28B generates bucket position data S based on reference position data P, revolving unit orientation data Q, and cylinder length data L. Target excavation topography data generation portion 28C generates target excavation topography U, by using bucket position data S obtained from bucket position data generation portion 28B and target construction information T stored in target construction information storage portion 28A and outputs that target excavation topography U to distance obtaining portion 53.

As shown in FIGS. 14 and 8, distance obtaining portion 53 obtains target excavation topography U from display controller 28 and calculates distance d based on bucket position data S of cutting edge 8*a* and target excavation topography U. The step of calculating distance d corresponds to step SA4 shown in FIG. 12.

Distance obtaining portion 53 outputs distance d to speed limit obtaining portion 54*c*. Speed limit obtaining portion 54*c* obtains speed limit Vcy_lmt of cutting edge 8*a* of bucket 8 based on the relation data input from selection portion 54*b* and distance d input from distance obtaining portion 53 (step SB5: FIG. 14). The step of obtaining speed limit Vcy_lmt corresponds to step SA5 shown in FIG. 12.

After speed limit Vcy_lmt is obtained, work implement controller 26 calculates a perpendicular speed component Vcy_bm_lmt of the speed limit (the target speed) (a limit perpendicular speed component) of boom 6 from speed limit Vcy_lmt of work implement 2 as a whole, boom estimated speed Vc_bm, and bucket estimated speed Vc_bkt (step SA6: FIG. 12).

As shown in FIGS. 12 and 6, work implement controller 26 converts limit perpendicular speed component Vcy_bm_lmt of boom 6 into speed limit of boom 6 (boom speed limit) Vc_bm_lmt (step SA7: FIG. 12).

Work implement controller 26 finds relation between a direction perpendicular to the surface of target excavation topography U and a direction of boom speed limit Vc_bm_lmt from an angle of pivot α of boom 6, an angle of pivot β of arm 7, an angle of pivot of bucket 8, vehicular main body position data P, and target excavation topography U, and converts limit perpendicular speed component Vcy_bm_lmt of boom 6 into boom speed limit Vc_bm_lmt. An operation in this case is performed in a procedure reverse to the operation for finding perpendicular speed component Vcy_bm in the direction perpendicular to the surface of target excavation topography U from boom estimated speed Vc_bm described previously.

As shown in FIGS. 14 and 6, speed limit obtaining portion 54*c* outputs obtained boom speed limit Vc_bm_lmt to work implement control unit 57. Work implement control unit 57 determines a cylinder speed corresponding to boom speed limit Vc_bm_lmt and outputs a command current (a control signal) corresponding to the cylinder speed to control valve 27A (step SB6: FIG. 14). Thus, control of work implement 2 including an amount of movement of the spool is carried out.

When cutting edge 8*a* is located above target excavation topography U, as cutting edge 8*a* is closer to target excavation topography U, an absolute value for limit perpendicular speed component Vcy_bm_lmt of boom 6 is smaller and an absolute value for a speed component of speed limit Vcx_bm_lmt of boom 6 in the direction in parallel to the surface of target excavation topography U (a limit horizontal speed component) is also smaller. Therefore, when cutting edge 8*a* is located above target excavation topography U, as cutting edge 8*a* is closer to target excavation topography U, a speed of boom 6 in the direction perpendicular to the surface of target excavation topography U and a speed of boom 6 in the direction in parallel to the surface of target excavation topography Ii are both reduced.

[Effect]

A different type of bucket 8 results in a different weight of bucket 8 in many cases. When bucket 8 different in weight is connected to arm 7, load applied to hydraulic cylinder 60 driving work implement 2 changes and a cylinder speed in response to an amount of movement of the spool of the direction control valve changes. Thus, control error in stop control is great, which may result in stop control with poor accuracy. Consequently, excavation accuracy may lower. For example, when replacement with a bucket large in weight is made, inertia of the bucket is greater and an operation of the work implement is more difficult to stop. Therefore, accuracy in stop under stop control deteriorates.

In contrast, according to the present embodiment, even when medium•small bucket 8 is replaced with large bucket 8, large bucket 8 being larger in weight than medium•small bucket 8 is specified. In a state that large bucket 8 is being used, a moving speed of bucket 8 can be reduced from a position more distant from the target design topography than in a state that medium•small bucket 8 is being used. Therefore, even in replacement with large bucket 8, invasion by cutting edge 8*a* of bucket 8 into the target design topography is suppressed. Thus, an expected operation in stop control can be performed and excavation accuracy can be enhanced.

Specifically, as shown in FIG. 13 (B), in a case that a moving speed of cutting edge 8*a* in the direction of the target design topography is set to Va, when a distance between cutting edge 8*a* of medium•small bucket 8 and the target design topography attains to db, reduction in moving speed of cutting edge 8*a* in the direction of the target design topography is started. In contrast, when a distance between cutting edge 8*a* of large bucket 8 and the target design topography attains to da which is larger than db, reduction in moving speed of cutting edge 8*a* in the direction of the target design topography is started, Thus, when medium•small bucket 8 is replaced with large bucket 8, a moving speed of cutting edge 8*a* is reduced from position da more distant from the target design topography than in a case that medium•small bucket 8 is used. Therefore, invasion by cutting edge 8*a* of bucket 8 into the target design topography can be prevented.

Alternatively, as shown in FIG. 13 (B), when large bucket 8 is replaced with medium•small bucket 8, a moving speed is reduced from position db closer to the target design topography than in a case that large bucket 8 is used. If a moving speed is automatically reduced from a position distant from the target design topography, it may be mistaken by an operator for failure of the work implement. Therefore, when medium•small bucket 8 is used, a moving speed is reduced from position db closer to the target design topography, so that sensory mistake by the operator can be suppressed.

Thus, stop control can accurately be carried out, excavation accuracy is enhanced, and sensory mistake by the operator can also be suppressed when cutting edge 8*a* of bucket 8 is aligned to the target design topography.

As shown in FIG. 13 (B), in the cutting edge speed limit table for a large bucket, a degree of deceleration with change in distance d between cutting edge 8*a* and the target design topography in second deceleration section D2 more distant from the target design topography is larger than a degree of deceleration with change in distance d between cutting edge 8*a* and the target design topography in first deceleration section. D1 closer to the target design topography. Thus, in moving bucket 8 large in weight toward the target design topography, at a position distant from the target design topography, a degree of deceleration with change in distance d between cutting edge 8*a* and the target design topography can be larger so as to sharply reduce a speed of bucket 8. At a position close to the target design topography, a degree of deceleration with change in distance d between cutting edge 8*a* and the target design topography can be smaller so as to accurately align cutting edge 8*a* of bucket 8 with the target design topography.

As shown in FIG. 13 (B), in the cutting edge speed limit table for medium•small buckets, a degree of deceleration with change in distance d between cutting edge 8 and the target design topography in fourth deceleration section D4 more distant from the target design topography is larger than a degree of deceleration with change in distance d between cutting edge 8*a* and the target design topography in third deceleration section D3 closer to the target design topography. Thus, in moving bucket 8 small in weight toward the target design topography, at a position distant from the target design topography, a degree of deceleration with change in distance d between cutting edge 8*a* and the target design topography can be larger so as to sharply reduce a speed of bucket 8. At a position close to the target design topography, a degree of deceleration with change in distance d between cutting edge 8*a* and the target design topography can be smaller so as to accurately align cutting edge 8*a* of bucket 8 with the target design topography.

<Modification>

In stop control in the present modification, in addition to control based on the relation data (the cutting edge speed limit table) shown in FIG. 13, control based on correlation data below may be carried out.

[Correlation Data]

According to the present modification, a spool stroke-cylinder speed characteristic made use of by cylinder speed operation portion 52B of estimated speed determination portion 52 in FIG. 9 is varied depending on a weight of a bucket. By doing so, difference in weight of a bucket can be reflected on an estimated speed and accuracy of the estimated speed can be enhanced, which leads to improvement in accuracy in stop control.

One example of a spool stroke-cylinder speed characteristic used in stop control in the modification above will be described below with reference to FIG. 15.

Figure 15:
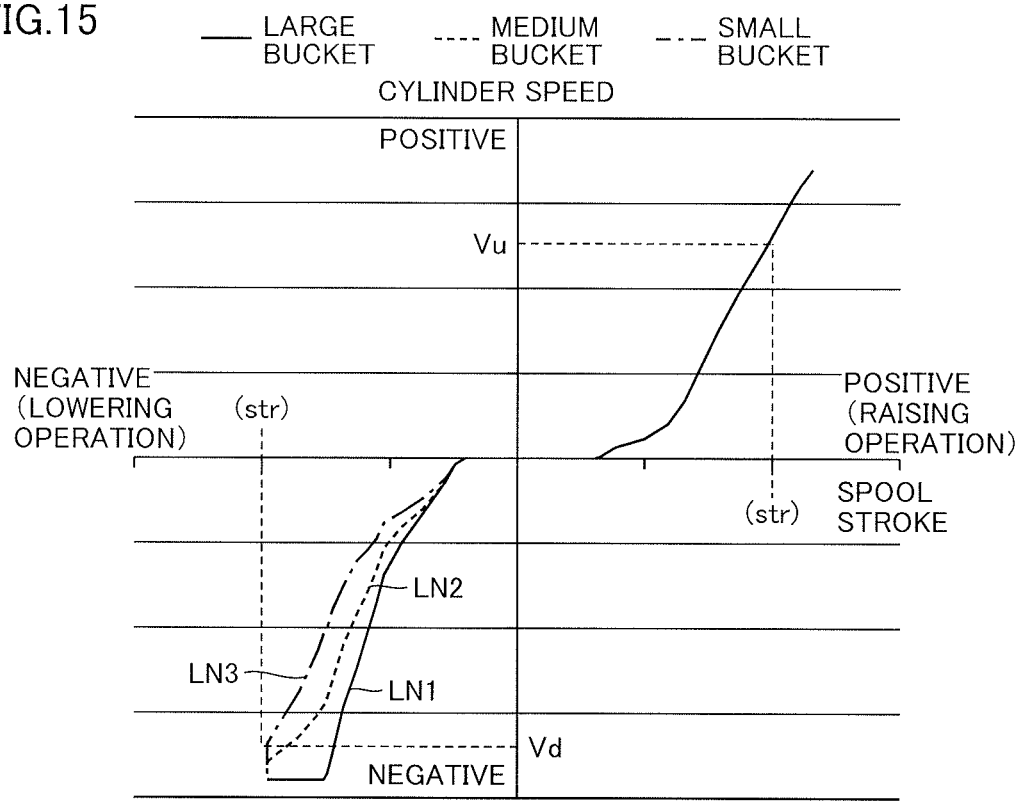
FIG. 15 is a diagram showing one example of first correlation data showing relation between a spool stroke and a cylinder speed based on a modification.

FIG. 15 is a diagram showing one example of a spool stroke-cylinder speed characteristic.

As shown in FIG. 15, the abscissa represents a spool stroke and the ordinate represents a cylinder speed. A state that the spool stroke is zero (at the origin) is a state that the spool is at an initial position. A line LN1 represents first correlation data in a case that bucket 8 has a large weight. A line LN2 represents first correlation data in a case that bucket 8 has a medium weight. A line LN3 represents first correlation data in a case that bucket 8 has a small weight. Thus, the first correlation data varies depending on a weight of bucket 8.

As the spool moves such that the spool stroke is positive, work implement 2 performs the raising operation. As the spool moves such that the spool stroke is negative, work implement 2 performs the lowering operation.

An amount of change in cylinder speed is different between the operation for raising work implement 2 and the operation for lowering work implement 2. Namely, an amount of change Vu in cylinder speed at the time when the spool stroke varies from the origin by a prescribed amount Str such that the raising operation is performed and an amount of change Vd in cylinder speed at the time when the spool stroke varies from the origin by prescribed amount Str such that the lowering operation is performed are different from each other. In the present modification, in particular based on the correlation data in connection with the lowering operation, an operation of work implement 2 is controlled in response to an operation command value (a spool stroke, a PPC pressure, and a cylinder speed).

In the operation for lowering boom 6, owing to an action of gravity (a self weight) of boom 6, work implement 2 moves faster than in the raising operation. In the operation for lowering work implement 2, the cylinder speed is higher as a weight of bucket 8 is larger. Therefore, in the operation for lowering boom 6 (work implement 2), a speed profile of the cylinder speed significantly varies depending on a weight of bucket 8.

When stop control is carried out, as described above, boom cylinder 10 performs the operation for lowering boom 6. Therefore, as boom cylinder 10 is controlled based on the first correlation data as shown in FIG. 15, even when a weight of bucket 8 changes, bucket 8 can accurately be moved based on target design topography U. Namely, even when a weight of bucket 8 is changed at the time of start of movement of hydraulic cylinder 60, hydraulic cylinder 60 is finely controlled so that highly accurate excavation limit control is carried out.

[Control Method]

One example of an operation of hydraulic excavator 100 according to the present modification will now be described with reference to FIG. 16.

Figure 16:
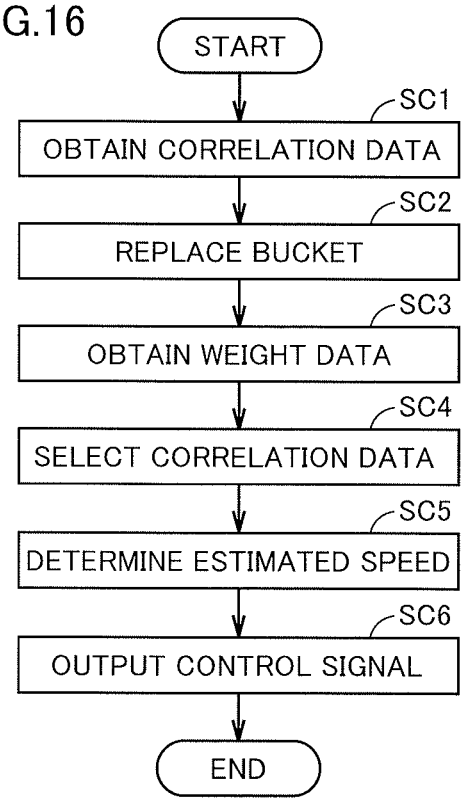
FIG. 16 is a flowchart for illustrating the stop control method with the use of first to third correlation data based on the modification.

As shown in FIGS. 8 and 16, a plurality of pieces of first correlation data are found depending on weights of buckets 8 and stored in storage portion 58 (step SC1: FIG. 16). Second correlation data (a PPC pressure-spool stroke characteristic) and third correlation data (a cylinder speed-estimated speed characteristic) may be stored in storage portion 58. A plurality of pieces of second correlation data and a plurality of pieces of third correlation data may be found depending on weights of buckets 8 and stored in storage portion 58.

After bucket 8 is replaced (step SC2: FIG. 16), an operator operates man-machine interface portion 32 so as to input weight data representing a weight of bucket 8 into bucket weight specifying portion 59 through input portion 321. Bucket weight specifying portion 59 obtains the weight data (step SC3: FIG. 16). Bucket weight specifying portion 59 outputs the weight data to estimated speed determination portion 52.

Estimated speed determination portion 52 selects one piece of first correlation data corresponding to the weight data from among the plurality of pieces of first correlation data stored in storage portion 58, based on the weight data (step SC4: FIG. 16). In the present modification, one piece of correlation data corresponding to the weight data of bucket 8 is selected from among the first correlation data shown with line LN1, the first correlation data shown with line LN2, and the first correlation data shown with line LN3 shown in FIG. 15. Similarly, the second correlation data and the third correlation data corresponding to the weight data are selected.

Estimated speed determination portion 52 determines an estimated speed based on the selected first correlation data, second correlation data, and third correlation data, and input information (a spool stroke, a PPC pressure, and a cylinder speed) (step SC5: FIG. 16). The step of determining an estimated speed corresponds to step SA2 shown in FIG. 12.

Specifically, estimated speed determination portion 52 determines a cylinder speed based on the input spool stroke with the use of the selected first correlation data. Estimated speed determination portion 52 determines an estimated speed based on the obtained cylinder speed, by using the selected second correlation data. As necessary, estimated speed determination portion 52 may determine a spool stroke from a pilot pressure (a PPC pressure) by using the third correlation data.

Estimated speed determination portion 52 outputs the determined estimated speed to speed limit obtaining portion 54*c*. Speed limit obtaining portion 54*c* determines speed limit Vc_bm_lmt of boom 6 in the flow shown in FIGS. 12 and 14, with the use of this estimated speed. Stop control unit 54 outputs that speed limit Vc_bm_lmt to work implement control unit 57.

Work implement control unit 57 obtains boom speed limit Vc_bm_lmt and generates control signal CBI based on that boom speed limit Vc_bm_lmt. Work implement control unit 57 outputs that control signal CBI to control valve 27C (step SC6: FIG. 16).

As above, work implement controller 26 shown in FIG. 8 can control boom 6 based on stop control such that cutting edge 8*a* of bucket 8 does not enter target excavation topography U.

<Others>

Though one embodiment of the present invention and the modification have been described above, the present invention is not limited to the embodiment and the modification above but various modifications can be made within the scope without departing from the spirit of the invention.

For example, control can also be carried out such that a speed limit of cutting edge 8*a* of bucket 8 continuously varies depending on a weight of bucket 8. For example, two cutting edge speed limit tables as shown in FIG. 13 are used and the two cutting edge speed limit tables are interpolated, so as to carry out control such that a speed limit of cutting edge 8*a* continuously varies.

Though use of two cutting edge speed limit tables as shown in FIG. 13 has been described above, the control above may be carried out based on operations without such tables being stored.

Though operation apparatus 25 is described above as a pilot hydraulic type, operation apparatus 25 may be of an electric lever type. For example, a control lever detection portion such as a potentiometer detecting an amount of operation of a control lever of operation apparatus 25 and outputting a voltage value in accordance with the amount of operation to work implement controller 26 may be provided. Work implement controller 26 may adjust a pilot oil pressure by outputting a control signal to control valve 27 based on a result of detection by the control lever detection portion. Present control is carried out by a work implement controller, however, it may be carried out by other controllers such as sensor controller 30.

Though storage portions 54*a* and 58 are separately shown as in FIG. 8 above, storage portions 54*a* and 58 may be contained in one RAM or ROM and may be implemented as a common storage portion. Alternatively, storage portions 54*a* and 58 may be contained in RAMs and/or ROMs different from each other.

Though hydraulic excavator 100 has been exemplified as a work vehicle in the above, the work vehicle is not limited to the hydraulic excavator and a work vehicle of another type may be adopted.

A position of hydraulic excavator 100 in the global coordinate system may be obtained by other positioning means, without being limited to GNSS. Therefore, distance d between cutting edge 8*a* and target design topography may be obtained by other positioning means, without being limited to GNSS.

Though the embodiment of the present invention has been described above, it should be understood that the embodiment disclosed herein is illustrative and non-restrictive in every respect. The scope of the present invention is defined by the terms of the claims, and is intended to include any modifications within the scope and meaning equivalent to the terms of the claims.

REFERENCE SIGNS LIST

1 vehicular main body; 2 work implement; 3 revolving unit; 4 operator's cab; 4S operator's seat; 5 traveling apparatus; 5Cr crawler belt; 6 boom; 7 arm; 8 bucket; 8*a* cutting edge; 9 engine compartment; 10 boom cylinder; 11 arm cylinder; 12 bucket cylinder; 13 boom pin; 14 arm pin; 15 bucket pin; 16 boom cylinder stroke sensor; 17 arm cylinder stroke sensor; 18 bucket cylinder stroke sensor; 19 handrail; 20 position detection apparatus; 21 antenna; 21A first antenna; 21B second antenna; 23 global coordinate operation portion; 25 operation apparatus; 25L second control lever; 25R first control lever; 26 work implement controller; 27, 27A, 27B, 27C control valve; 28 display controller; 28A target construction information storage portion; 28B bucket position data generation portion; 28C target excavation topography data generation portion; 29, 322 display portion; 30 sensor controller; 32 man-machine interface portion; 40A cap side oil chamber; 40B rod side oil chamber; 51 shuttle valve; 52 estimated speed determination portion; 52A spool stroke operation portion; 52B cylinder speed operation portion; 52C target speed operation portion; 53 distance obtaining portion; 54 stop control unit; 54*a*, 58 storage portion; 54*b* selection portion; 54*c* speed limit obtaining portion; 57 work implement control unit; 59 bucket weight specifying portion; 60 hydraulic cylinder; 63 revolution motor; 64 direction control valve; 65 spool stroke sensor; 66, 67, 68 pressure sensor; 80 spool; 100 work vehicle; 200 control system; 300 hydraulic system; 321 input portion; 450 pilot oil path; and 451, 451A, 451B, 452, 452A, 452B, 501, 502 oil path.

The invention claimed is:

1. A work vehicle, comprising:

a work implement including a boom, an arm, and a bucket;

a weight specifying portion which specifies a weight of said bucket attached to said arm;

a distance obtaining portion which obtains a distance between a cutting edge of said bucket and target design topography; and a stop control unit which carries out stop control for stopping an operation of said work implement before said cutting edge of said bucket reaches said target design topography when said cutting edge of said bucket comes closer to said target design topography, and carries out control, when a moving speed of said bucket in a direction toward said target design topography is equal in both of a first specifying state in which said weight specifying portion specifies a weight of said bucket as a first weight and a second specifying state in which said weight specifying portion specifies a weight of said bucket as a second weight smaller than said first weight, such that the moving speed of said bucket in the direction toward said target design topography is reduced from a position more distant from said target design topography in said first specifying state than in said second specifying state.

2. The work vehicle according to claim 1, wherein said stop control unit has a storage portion storing a plurality of pieces of relation data corresponding to a plurality of weights of said buckets, respectively, each of the plurality of pieces of relation data defining relation between a distance between said cutting edge of said bucket and said target design topography and a speed limit of said cutting edge of said bucket, a selection portion selecting one piece of relation data among the plurality of pieces of said relation data stored in said storage portion, based on the weight of said bucket specified by said weight specifying portion, and a speed limit obtaining portion obtaining said speed limit of said cutting edge of said bucket based on said distance obtained by said distance obtaining portion, by using said one piece of relation data selected by said selection portion, and said stop control unit carries out said stop control based on said speed limit of said cutting edge of said bucket.

3. The work vehicle according to claim 2, wherein the plurality of pieces of said relation data include first relation data and second relation data, the weight of said bucket when said first relation data is selected is larger than the weight of said bucket when said second relation data is selected, and said distance in said first relation data at which reduction in said speed limit of said cutting edge of said bucket is started is larger than said distance in said second relation data at which reduction in said speed limit of said cutting edge of said bucket is started.

4. The work vehicle according to claim 3, wherein said first relation data has a first deceleration section and a second deceleration section, and said first deceleration section is set at a position closer to said target design topography than said second deceleration section and a degree of deceleration with change in distance between said cutting edge of said bucket and said target design topography in said second deceleration section is larger than a degree of deceleration with change in distance between said cutting edge of said bucket and said target design topography in said first deceleration section.

5. The work vehicle according to claim 4, wherein said second relation data has a third deceleration section and a fourth deceleration section, said third deceleration section is set at a position closer to said target design topography than said fourth deceleration section and a degree of deceleration with change in distance between said cutting edge of said bucket and said target design topography in said fourth deceleration section is larger than a degree of deceleration with change in distance between said cutting edge of said bucket and said target design topography in said third deceleration section, and said fourth deceleration section is set at a position closer to said target design topography than said second deceleration section.

6. The work vehicle according to claim 2, further comprising:

an estimated speed determination portion which estimates a speed of said boom based on an amount of operation of an operation member; and a direction control valve which has a movable spool and controls supply of a hydraulic oil to a hydraulic cylinder driving said work implement as said spool moves, wherein said storage portion stores a plurality of pieces of correlation data corresponding to a plurality of weights of said buckets, respectively, each pieces of correlation data showing relation between a cylinder speed of said hydraulic cylinder and an operation command value for operating said hydraulic cylinder, said estimated speed determination portion selects one piece of correlation data from among the plurality of pieces of said correlation data stored in said storage portion based on the weight of said bucket specified by said weight specifying portion and obtains an estimated speed of said boom by using selected said one piece of correlation data, and said stop control unit carries out said stop control based on said estimated speed of said boom and said speed limit of said boom.

7. The work vehicle according to claim 1, further comprising a hydraulic cylinder which drives said work implement, wherein said weight specifying portion specifies a weight of said bucket attached to said arm based on a pressure generated in said hydraulic cylinder while said bucket is in air.

8. The work vehicle according to claim 1, further comprising a monitor onto which an operator can perform an operation for input of a weight of said bucket, wherein said weight specifying portion specifies a weight of said bucket attached to said arm based on the weight of said bucket input to said monitor by said operator.

* * * * *